US006775486B2

(12) United States Patent
Matsuyama et al.

(10) Patent No.: US 6,775,486 B2
(45) Date of Patent: Aug. 10, 2004

(54) IMAGE FORMING APPARATUS

(75) Inventors: Kazuhiro Matsuyama, Ikoma (JP); Yoshinobu Tateishi, Nara (JP); Toshiya Mikita, Yao (JP); Masashi Hirai, Katano (JP); Toshio Yamanaka, Yao (JP); Mitsuyoshi Terada, Osaka (JP); Yuji Nakagawa, Kyoto (JP); Osamu Fujimoto, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/365,376

(22) Filed: Feb. 11, 2003

(65) Prior Publication Data

US 2003/0156298 A1 Aug. 21, 2003

(30) Foreign Application Priority Data

Feb. 15, 2002 (JP) ..... P2002-038749
Oct. 25, 2002 (JP) ..... P2002-311469

(51) Int. Cl.[7] ..... G03G 15/00
(52) U.S. Cl. ..... 399/21; 399/18
(58) Field of Search ..... 399/18, 19, 20, 399/21, 11, 124, 388

(56) References Cited

U.S. PATENT DOCUMENTS 5,502,545 A * 3/1996 Tsuruoka ..... 399/21
5,532,793 A * 7/1996 Kogure ..... 399/19
5,761,567 A * 6/1998 Yoshizuka ..... 399/17
5,893,657 A * 4/1999 Matsuzawa ..... 399/18
5,970,274 A * 10/1999 Rath ..... 399/21
6,011,936 A * 1/2000 Kaneko ..... 399/21

FOREIGN PATENT DOCUMENTS

| | | |
|---|---|---|
| JP | 62-264144 | 11/1979 |
| JP | 05-053405 | 5/1993 |
| JP | 07-281534 | 10/1995 |
| JP | 11-119490 | 4/1999 |

* cited by examiner

*Primary Examiner*—Ren Yan
(74) *Attorney, Agent, or Firm*—Renner, Otto, Boisselle & Sklar, LLP

(57) ABSTRACT

An image forming apparatus transfers a toner image formed on a photoconductor drum onto a sheet-like recording member while the sheet-like recording member is transported and attracted to a transfer belt, and comprises a jam handling control unit for detecting a transport fault of the sheet-like recording member, and for stopping the transport operation when the transport fault is detected. When the transport fault is detected in a section other than a fixing section, the jam handling control unit first causes the transport operation of the fixing section, and thereafter causes the transfer belt and the transport operation on the upstream side thereof to stop, and any sheet-like recording member remaining on the transfer belt so that the transport mechanism on the upstream side thereof is transported and stopped at the position spanning between the area of the fixing section and the area of the transfer belt.

7 Claims, 18 Drawing Sheets

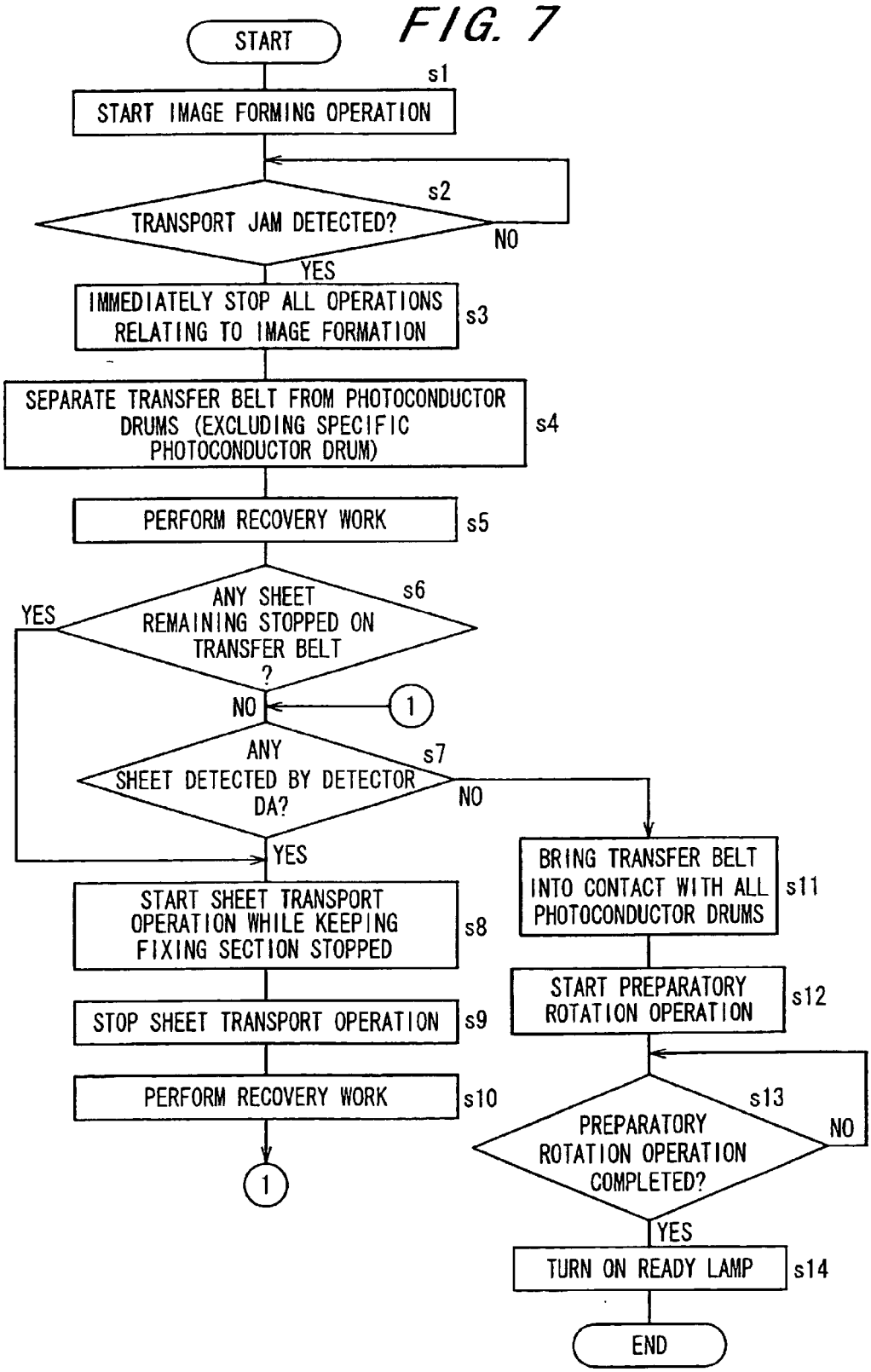
FIG. 7
START
s1
START IMAGE FORMING OPERATION
s2
TRANSPORT JAM DETECTED?
NO
YES
IMMEDIATELY STOP ALL OPERATIONS RELATING TO IMAGE FORMATION
s3
SEPARATE TRANSFER BELT FROM PHOTOCONDUCTOR DRUMS (EXCLUDING SPECIFIC PHOTOCONDUCTOR DRUM)
s4
PERFORM RECOVERY WORK
s5
ANY SHEET REMAINING STOPPED ON TRANSFER BELT ?
s6
YES
NO
1
ANY SHEET DETECTED BY DETECTOR DA?
s7
NO
YES
START SHEET TRANSPORT OPERATION WHILE KEEPING FIXING SECTION STOPPED
s8
STOP SHEET TRANSPORT OPERATION
s9
PERFORM RECOVERY WORK
s10
1
BRING TRANSFER BELT INTO CONTACT WITH ALL PHOTOCONDUCTOR DRUMS
s11
START PREPARATORY ROTATION OPERATION
s12
PREPARATORY ROTATION OPERATION COMPLETED?
s13
NO
YES
TURN ON READY LAMP
s14
END

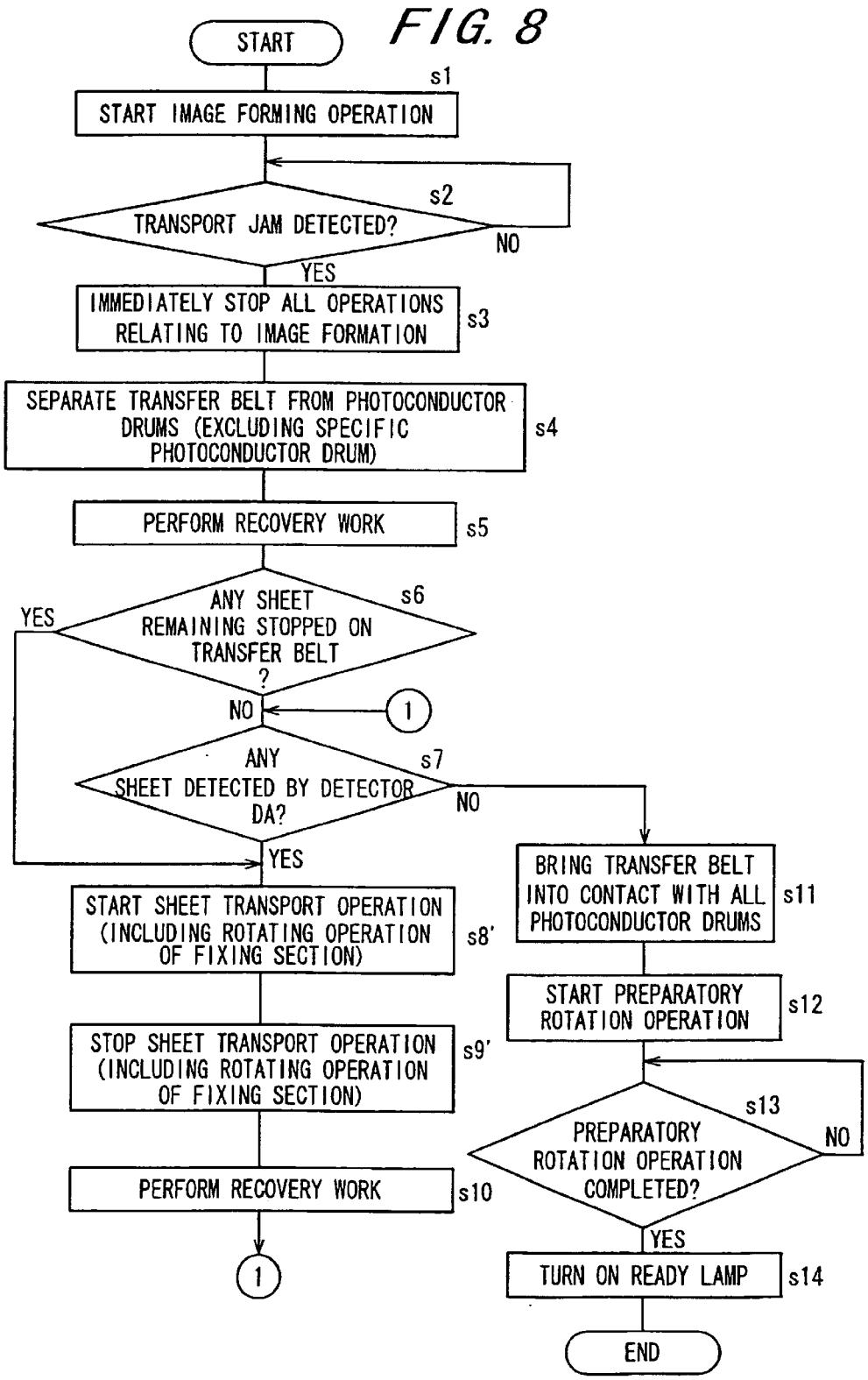
FIG. 8
START
s1
START IMAGE FORMING OPERATION
s2
TRANSPORT JAM DETECTED?
NO
YES
IMMEDIATELY STOP ALL OPERATIONS RELATING TO IMAGE FORMATION
s3
SEPARATE TRANSFER BELT FROM PHOTOCONDUCTOR DRUMS (EXCLUDING SPECIFIC PHOTOCONDUCTOR DRUM)
s4
PERFORM RECOVERY WORK
s5
ANY SHEET REMAINING STOPPED ON TRANSFER BELT ?
s6
YES
NO
1
ANY SHEET DETECTED BY DETECTOR DA?
s7
NO
YES
START SHEET TRANSPORT OPERATION (INCLUDING ROTATING OPERATION OF FIXING SECTION)
s8'
STOP SHEET TRANSPORT OPERATION (INCLUDING ROTATING OPERATION OF FIXING SECTION)
s9'
PERFORM RECOVERY WORK
s10
1
BRING TRANSFER BELT INTO CONTACT WITH ALL PHOTOCONDUCTOR DRUMS
s11
START PREPARATORY ROTATION OPERATION
s12
PREPARATORY ROTATION OPERATION COMPLETED?
s13
NO
YES
TURN ON READY LAMP
s14
END

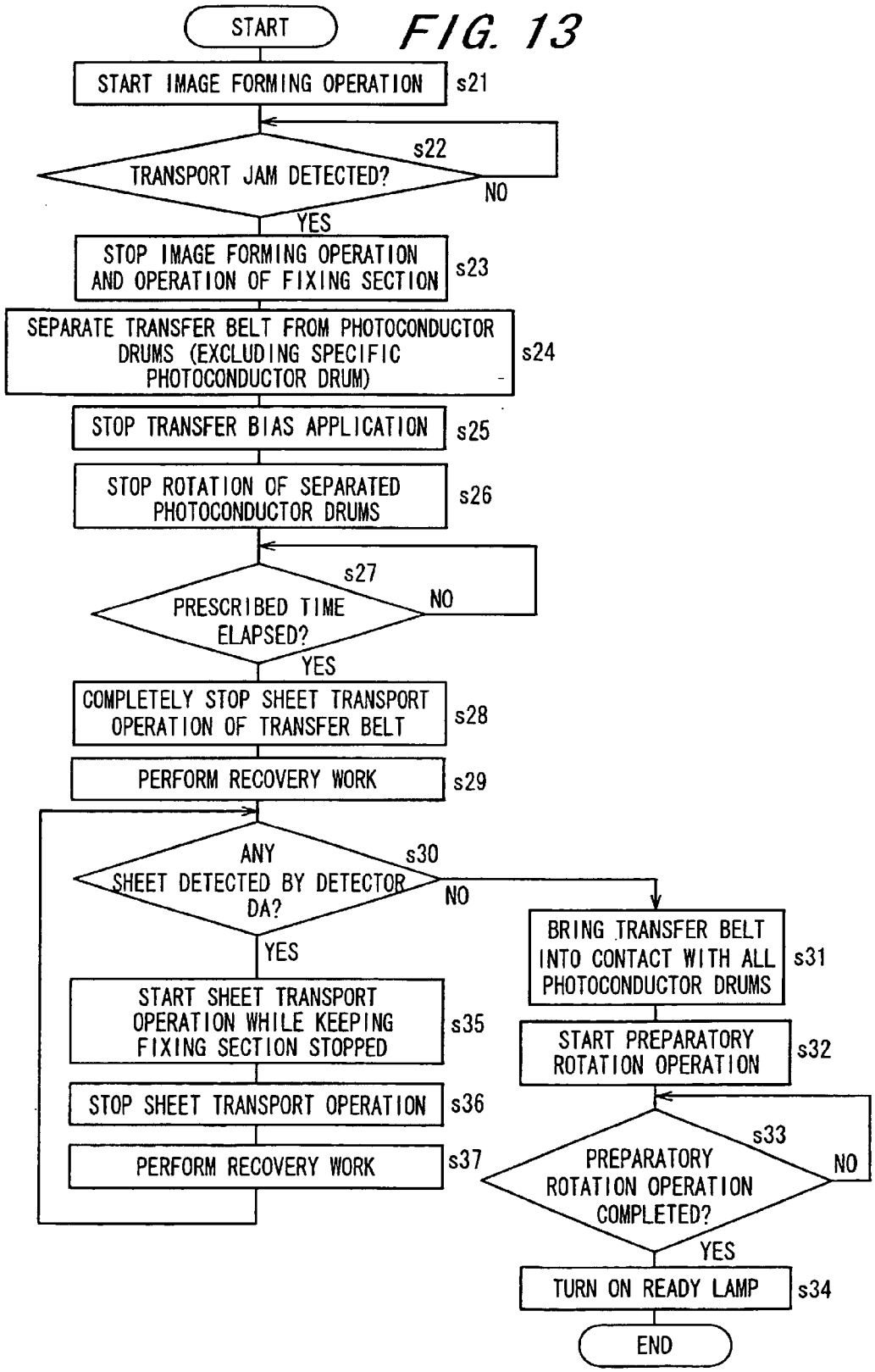
FIG. 13
START
START IMAGE FORMING OPERATION
s21
TRANSPORT JAM DETECTED?
s22
NO
YES
STOP IMAGE FORMING OPERATION AND OPERATION OF FIXING SECTION
s23
SEPARATE TRANSFER BELT FROM PHOTOCONDUCTOR DRUMS (EXCLUDING SPECIFIC PHOTOCONDUCTOR DRUM)
s24
STOP TRANSFER BIAS APPLICATION
s25
STOP ROTATION OF SEPARATED PHOTOCONDUCTOR DRUMS
s26
PRESCRIBED TIME ELAPSED?
s27
NO
YES
COMPLETELY STOP SHEET TRANSPORT OPERATION OF TRANSFER BELT
s28
PERFORM RECOVERY WORK
s29
ANY SHEET DETECTED BY DETECTOR DA?
s30
NO
YES
BRING TRANSFER BELT INTO CONTACT WITH ALL PHOTOCONDUCTOR DRUMS
s31
START SHEET TRANSPORT OPERATION WHILE KEEPING FIXING SECTION STOPPED
s35
START PREPARATORY ROTATION OPERATION
s32
STOP SHEET TRANSPORT OPERATION
s36
PERFORM RECOVERY WORK
s37
PREPARATORY ROTATION OPERATION COMPLETED?
s33
NO
YES
TURN ON READY LAMP
s34
END

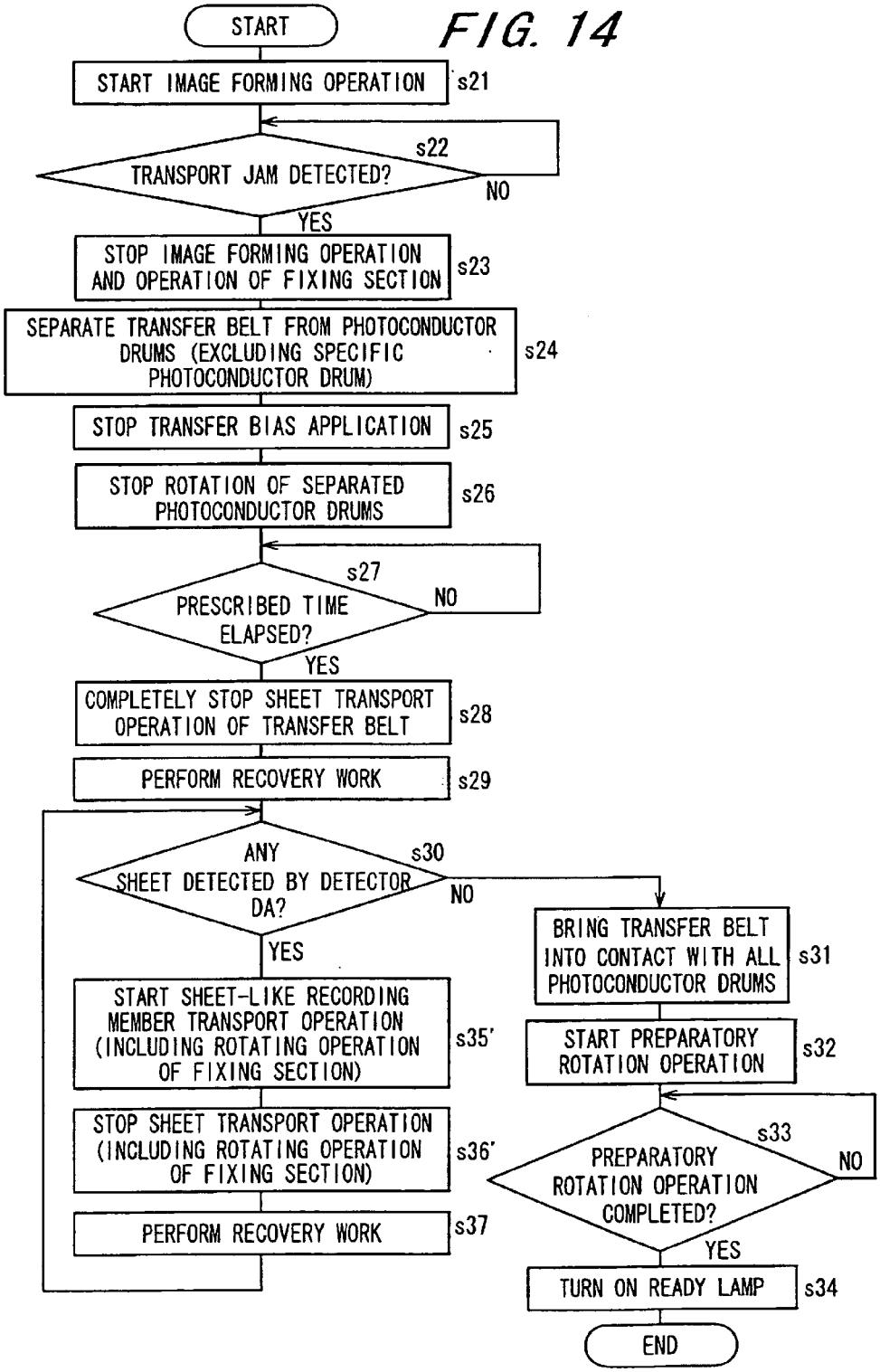
FIG. 14
START
START IMAGE FORMING OPERATION
s21
TRANSPORT JAM DETECTED?
s22
NO
YES
STOP IMAGE FORMING OPERATION AND OPERATION OF FIXING SECTION
s23
SEPARATE TRANSFER BELT FROM PHOTOCONDUCTOR DRUMS (EXCLUDING SPECIFIC PHOTOCONDUCTOR DRUM)
s24
STOP TRANSFER BIAS APPLICATION
s25
STOP ROTATION OF SEPARATED PHOTOCONDUCTOR DRUMS
s26
PRESCRIBED TIME ELAPSED?
s27
NO
YES
COMPLETELY STOP SHEET TRANSPORT OPERATION OF TRANSFER BELT
s28
PERFORM RECOVERY WORK
s29
ANY SHEET DETECTED BY DETECTOR DA?
s30
NO
YES
BRING TRANSFER BELT INTO CONTACT WITH ALL PHOTOCONDUCTOR DRUMS
s31
START SHEET-LIKE RECORDING MEMBER TRANSPORT OPERATION (INCLUDING ROTATING OPERATION OF FIXING SECTION)
s35'
START PREPARATORY ROTATION OPERATION
s32
STOP SHEET TRANSPORT OPERATION (INCLUDING ROTATING OPERATION OF FIXING SECTION)
s36'
PREPARATORY ROTATION OPERATION COMPLETED?
s33
NO
PERFORM RECOVERY WORK
s37
YES
TURN ON READY LAMP
s34
END

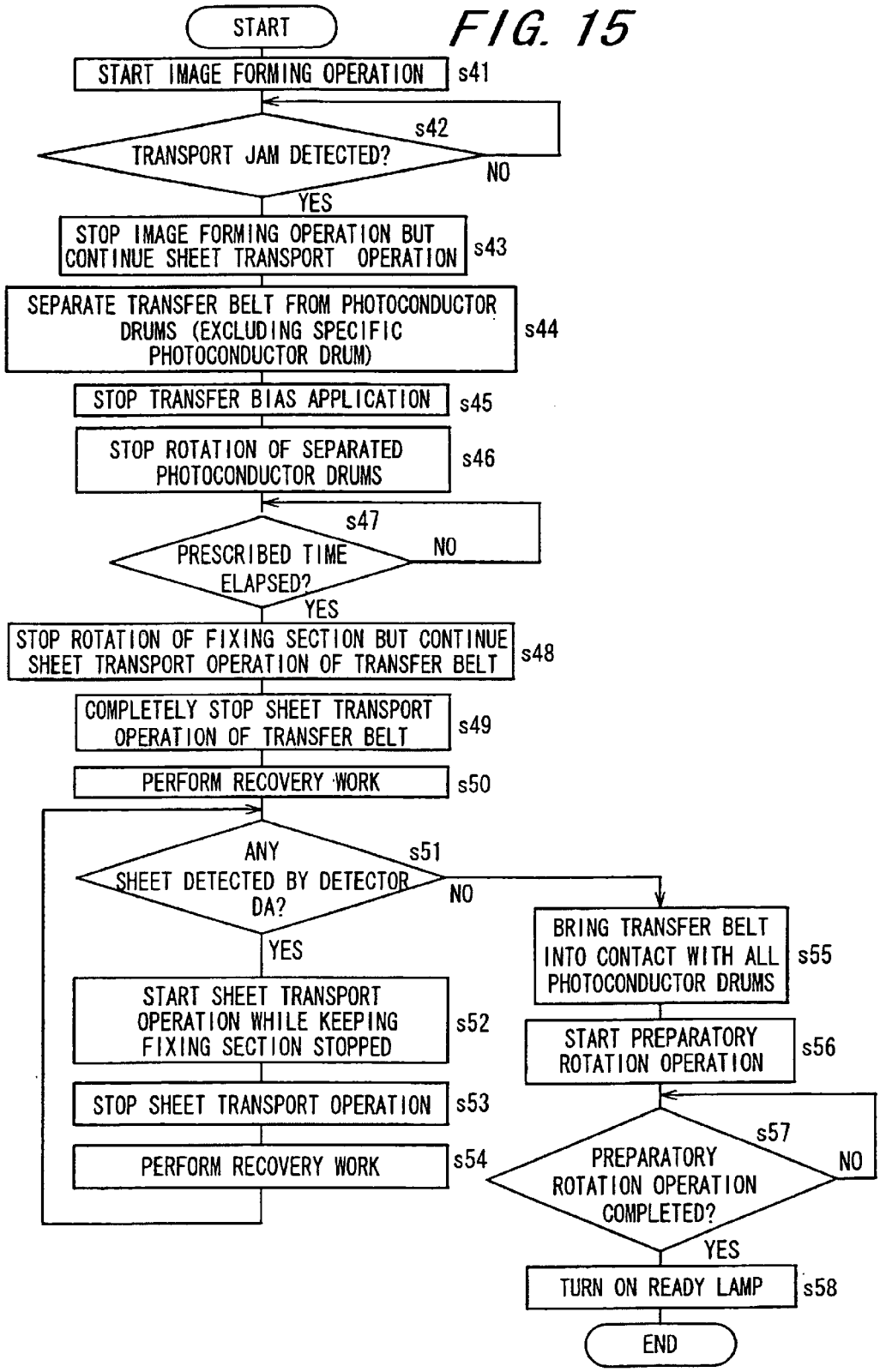
FIG. 15
START
START IMAGE FORMING OPERATION
s41
TRANSPORT JAM DETECTED?
s42
NO
YES
STOP IMAGE FORMING OPERATION BUT CONTINUE SHEET TRANSPORT OPERATION
s43
SEPARATE TRANSFER BELT FROM PHOTOCONDUCTOR DRUMS (EXCLUDING SPECIFIC PHOTOCONDUCTOR DRUM)
s44
STOP TRANSFER BIAS APPLICATION
s45
STOP ROTATION OF SEPARATED PHOTOCONDUCTOR DRUMS
s46
PRESCRIBED TIME ELAPSED?
s47
NO
YES
STOP ROTATION OF FIXING SECTION BUT CONTINUE SHEET TRANSPORT OPERATION OF TRANSFER BELT
s48
COMPLETELY STOP SHEET TRANSPORT OPERATION OF TRANSFER BELT
s49
PERFORM RECOVERY WORK
s50
ANY SHEET DETECTED BY DETECTOR DA?
s51
NO
YES
START SHEET TRANSPORT OPERATION WHILE KEEPING FIXING SECTION STOPPED
s52
STOP SHEET TRANSPORT OPERATION
s53
PERFORM RECOVERY WORK
s54
BRING TRANSFER BELT INTO CONTACT WITH ALL PHOTOCONDUCTOR DRUMS
s55
START PREPARATORY ROTATION OPERATION
s56
PREPARATORY ROTATION OPERATION COMPLETED?
s57
NO
YES
TURN ON READY LAMP
s58
END

MULTICOLOR MODE

SINGLE-COLOR MODE

IMAGE FORMING APPARATUS

BACKGROUND OF THE INVENTION

1. Field of the Invention

The present invention relates to an image forming apparatus, such as a copying machine, printer, fax machine, or the like, for forming various kinds of images on sheet-like recording members, and more particularly to a technique for handling a jam which occurs during transport of sheet-like recording members.

2. Description of the Related Art

Image forming apparatuses are well known in the prior art; in such apparatuses, a toner image formed on an image carrier is transferred to a sheet-like recording member by making the toner image electrostatically adhere to it by a transfer carrier, and thereafter the toner image is affixed onto the sheet-like recording member in a fixing section to accomplish the formation of the image. In a certain type of such image forming apparatuses, in particular, a tandem image forming apparatus which comprises a plurality of image forming stations each having an image carrier with various process units arranged around it, a single transfer carrier is formed facing the image carriers in all of the image forming stations, that is, the transfer carrier runs along the entire length of the image forming station array.

As a result, when any one of the sheet-like recording members being transported in succession gets jammed, causing an emergency stop of the image forming apparatus, in many cases the sheet-like recording members remain stopped between the transfer carrier and the image carriers. In particular, if a transport jam occurs in the fixing section, the operation must be stopped immediately. In such cases, it is highly likely that the succeeding sheet-like recording members remain stopped between the transfer carrier and the image carriers.

If a sheet-like recording member stops between the transfer carrier and the image carriers, it is difficult to remove the thus stopped sheet-like recording member by picking it up with fingers, since not only is the sheet-like recording member electrostatically attracted to the transfer carrier, but the transfer carrier is brought into contact with the image carriers. To address this problem, Japanese Unexamined Patent Publication JP-A 62-264144 (1987) and Japanese Unexamined Patent Publication JP-A 7-281534 (1995), for example, propose a paper transport apparatus and a separation failed paper removal apparatus in which, when a jam occurs, the transfer carrier is driven in the reverse direction to the normal paper transport direction and thereby moves the jammed sheet-like recording member back to a position where it can be easily removed.

However, it is difficult to visually locate the sheet-like recording member lying between the transfer carrier and the image carriers; besides, since an image forming apparatus is usually not equipped with means for detecting a sheet-like recording member lying on the transfer carrier, it is difficult for the image forming apparatus itself or the operator to check whether the jammed sheet-like recording member remains attracted to the transfer carrier.

Accordingly, the configuration in which the transfer carrier is driven in the reverse direction whenever a jam occurs has the problem that, if the sheet-like recording member is not on the transfer carrier, the reversing action is of no use and is not only time wasting but also uneconomical. On the other hand, if a detector for detecting a sheet-like recording member on the transfer carrier is to be installed, there arises the problem that the number of components increases, increasing the manufacturing and assembly costs as well as the overall size of the image forming apparatus.

Japanese Unexamined Patent Publication JP-A 5-53405 (1993) proposes an image forming apparatus in which, when a sheet-like recording member gets jammed, only the fixing section is stopped but other sections are operated for a prescribed period of time in order to transport the sheet-like recording member to the position just before the fixing section to facilitate the removal of the jammed sheet-like recording member.

Further, Japanese Unexamined Patent Publication JP-A 11-119490 (1999) proposes an image forming apparatus in which, when a sheet-like recording member gets jammed, the transfer bias applied to the transfer carrier is cut off when transporting the sheet-like recording member to the position just before the fixing section, thereby attempting to reduce the attractive force between the sheet-like recording member and the transfer carrier to a certain degree to facilitate the removal of the jammed sheet-like recording member.

However, the attractive force acting between the transfer carrier and the sheet-like recording member is generated not only by the transfer bias applied to the transfer carrier but also by the attractive force given to the sheet-like recording member by contacting with the charged image carriers.

Accordingly, the force working to attract the sheet-like recording member to the transfer carrier cannot be reduced by merely cutting off the transfer bias as in JP-A 11-119490 cited above, and the attractive force between the transfer carrier and the sheet-like recording member remains high; therefore, there remains the concern that the difficulty in removing the jammed sheet-like recording member cannot be solved with the above arrangement.

SUMMARY OF THE INVENTION

In view of the above situation, an object of the invention is to provide an image forming apparatus that can accomplish jam handling efficiently without increasing the number of components and without increasing the manufacturing and assembly costs. Another object of the invention is to provide an image forming apparatus that further improves the jam handling efficiency by reducing the attractive force between transfer carrier and sheet-like recording member as much as possible.

The invention provides an image forming apparatus comprising: an image carrier for carrying a toner image formed thereon; a transfer carrier for transferring the toner image formed on the image carrier to a sheet-like recording member which is transported and attracted to the transfer carrier; and jam handling control means for detecting a transport fault of the sheet-like recording member, and for stopping a transport operation for the sheet-like recording member when the transport fault is detected, wherein after completing recovery work for handling an abnormally stopped sheet-like recording member, if the presence of some other sheet-like recording member transported partway through is detected immediately before or after resuming the sheet-like recording member transport operation, the jam handling control means controls the operation of the transfer carrier in such a way that the sheet-like recording member is transported and stopped at an easy-to-retrieve position.

According to this invention, when performing the recovery work such as removing the sheet-like recording member remaining inside the image forming apparatus after an abnormal stop, that is, an emergency stop, occurred due to a transport jam or the like, any sheet-like recording member remaining between the image carrier and the transfer carrier, and therefore likely to be left unnoticed, or any sheet-like recording member electrostatically attracted to the transfer carrier and hard to remove is transported to an easy-to-retrieve position to facilitate the removal of the jammed sheet-like recording member.

According to this invention, when the sheet-like recording member transport operation is resumed after completing the recovery work for handling the abnormally stopped sheet-like recording member, if the presence of some other sheet-like recording member is detected, for example, by a detector, the sheet-like recording member is transported to an easy-to-retrieve position and the transport operation is stopped; in this way, after completing the recovery work, any sheet-like recording member remaining between the image carrier and the transfer carrier, and therefore likely to be left unnoticed, or any sheet-like recording member electrostatically attracted to the transfer carrier and hard to remove can be transported to an easy-to-retrieve position. Accordingly, the jam handling efficiency can be improved without increasing the number of components and without increasing the manufacturing and assembly costs.

In the invention it is preferable that the image forming apparatus further comprises a fixing unit capable of being drawn out in the transport direction of the sheet-like recording member provided on the downstream side of the transfer carrier as viewed along the transport direction of the sheet-like recording member, and that the easy-to-retrieve position is a position spanning between an area where the fixing unit is located and an area where the transfer carrier is located.

According to this invention, since the sheet-like recording member is stopped at the position spanning between the transfer carrier and the fixing unit, when the fixing unit is drawn out of the image forming apparatus the sheet-like recording member can be easily removed.

According to the invention, since the easy-to-retrieve position is spanning between the area of the fixing unit and the area of the transfer carrier, the fixing unit is drawn out of the image forming apparatus the sheet-like recording member can be easily removed.

In the invention it is preferable that the easy-to-retrieve position spanning between the area of the fixing unit and the area of the transfer carrier is a position just before the lead edge of the sheet-like recording member is caught between roller members of the fixing unit.

According to this invention, when the fixing unit is drawn out of the image forming apparatus, since the lead edge of the sheet-like recording member is protruding from the transfer carrier, the sheet-like recording member can be easily removed by grabbing its lead edge, even if the sheet-like recording member is electrostatically attracted to the transfer carrier.

According to this invention, since the easy-to-retrieve position spanning between the area of the fixing unit and the area of the transfer carrier is a position just before the lead edge of the sheet-like recording member is caught between the roller members of the fixing unit, when the fixing unit is drawn out of the image forming apparatus the lead edge of the sheet-like recording member is protruding from the transfer carrier, that is, lies outside the transfer carrier; accordingly, the sheet-like recording member can be easily removed by grabbing its lead edge, even if the sheet-like recording member is electrostatically attracted to the transfer carrier.

In the invention it is preferable that the easy-to-retrieve position spanning between the area of the fixing unit and the area of the transfer carrier is a position where the lead edge of the sheet-like recording member is caught between roller members of the fixing unit.

According to this invention, when the fixing unit is drawn out of the image forming apparatus, the sheet-like recording member caught between the roller members of the fixing unit is also drawn out; accordingly, the sheet-like recording member can be easily removed even if it is electrostatically attracted to the transfer carrier. Furthermore, since there is no need to put a hand into the apparatus to remove the sheet-like recording member from the transfer carrier, the invention serves to reduce such danger as getting an unpleasant electrical shock from a discharge or the like, or accidentally getting hurt when withdrawing the hand in surprise at the electrical shock.

According to this invention, since the easy-to-retrieve position spanning between the area of the fixing unit and the area of the transfer carrier is a position where the lead edge of the sheet-like recording member is caught between the roller members of the fixing unit, when the fixing unit is drawn out of the image forming apparatus the sheet-like recording member is also drawn out; accordingly, the sheet-like recording member can be easily removed even if it is electrostatically attracted to the transfer carrier.

The invention also provides an image forming apparatus an image forming apparatus comprising: an image carrier for carrying a toner image formed thereon; a transfer carrier for transferring the toner image formed on the image carrier to a sheet-like recording member which is transported and attracted to the transfer carrier; jam handling control means for detecting a transport fault of the sheet-like recording member, and for stopping a transport operation for the sheet-like recording member when the transport fault is detected; and a fixing unit capable of being drawn out in the transport direction of the sheet-like recording member, the fixing unit being disposed on the downstream side of the transport of the transfer carrier as viewed along the transport direction of the sheet-like recording member, wherein when the sheet transport fault is detected, the jam handling control means first causes the sheet-like recording member transport operation of the fixing unit to stop and thereafter causes the transport operation of the transfer carrier and sheet transport means on the upstream side thereof to stop so that any sheet-like recording member remaining on the transfer carrier or on the sheet transport means on the upstream side thereof is transported and stopped at a prescribed position spanning between an area where the fixing unit is located and an area where the transfer carrier is located.

According to this invention, since any sheet-like recording member remaining between the image carrier and the transfer carrier, and therefore likely to be left unnoticed, and any sheet-like recording member electrostatically attracted to the transfer carrier and hard to remove are transported to an easy-to-retrieve position, the jam handling can be performed efficiently.

According to this invention, when a sheet transport fault is detected in a section other than the fixing unit, first the sheet-like recording member transport operation of the fixing unit is stopped and thereafter the transport operation of the transfer carrier and the sheet transport means on the upstream side thereof is stopped so that any sheet remaining on the upstream-side sheet-like recording member transport means including the transfer carrier is transported and stopped at the position spanning between the area of the fixing unit and the area of the transfer carrier; in this way, since any sheet-like recording member remaining between the image carrier and the transfer carrier, and therefore likely to be left unnoticed, and any sheet-like recording member electrostatically attracted to the transfer carrier and hard to remove are made easy to retrieve, the recovery work can be accomplished in a single jam handling operation, and thus the jam handling efficiency can be drastically improved without increasing the number of components and without increasing the manufacturing and assembling costs.

In the invention it is preferable that the prescribed position spanning between the area of the fixing unit and the area of the transfer carrier is a position just before the lead edge of the sheet-like recording member is caught between roller members of the fixing unit.

According to this invention, when the fixing unit is drawn out of the image forming apparatus, since the lead edge of the sheet-like recording member is protruding from the transfer carrier, the sheet-like recording member can be easily removed by grabbing its lead edge, even if the sheet-like recording member is electrostatically attracted to the transfer carrier.

According to this invention, since the sheet-like recording member is stopped at the position spanning between the area of the fixing unit and the area of the transfer carrier, and more specifically at the position just before the lead edge of the sheet-like recording member is caught between the roller members of the fixing unit, when the fixing unit is drawn out of the image forming apparatus the lead edge of the sheet-like recording member is protruding from the transfer carrier; accordingly, the sheet-like recording member can be easily removed by grabbing its lead edge, even if the sheet-like recording member is electrostatically attracted to the transfer carrier, and thus the recovery work can be accomplished in a single jam handling operation.

In the invention it is preferable that the prescribed position spanning between the area of the fixing unit and the area of the transfer carrier is a position where the lead edge of a leading sheet-like recording member is caught between roller members of the fixing unit and where a succeeding sheet-like recording member is at a position just before the lead edge thereof is caught between the roller members of the fixing unit.

According to this invention, when the fixing unit is drawn out of the image forming apparatus, since the lead edge of the sheet-like recording member is protruding from the transfer carrier, the sheet-like recording member can be easily removed by grabbing its lead edge, even if the sheet-like recording member is electrostatically attracted to the transfer carrier.

Further, when the fixing unit is drawn out of the image forming apparatus, since the sheet-like recording member caught between the roller members of the fixing unit is also drawn out, the sheet-like recording member can be easily removed even if it is electrostatically attracted to the transfer carrier.

According to this invention, the sheet-like recording members are stopped at the position spanning between the area of the fixing unit and the area of the transfer carrier, and more specifically at the position where the lead edge of the leading sheet-like recording member is caught between the roller members of the fixing unit and where the succeeding sheet-like recording member is at the position just before the lead edge thereof is caught between the roller members of the fixing unit; therefore, when the fixing unit is drawn out of the image forming apparatus, the leading sheet-like recording member caught between the roller members of the fixing unit is also drawn out while leaving the lead edge of the succeeding sheet-like recording member protruding from the transfer carrier, so that even if the sheet-like recording member is electrostatically attracted to the transfer carrier, the sheet-like recording member can be easily removed by grabbing its lead edge, and thus the recovery work can be accomplished in a single jam handling operation.

The image forming apparatus of the invention further comprises a transfer carrier unit for supporting the transfer carrier thereon; and a moving mechanism for causing the transfer carrier to be brought into contact with or be separated from the image carrier by moving the transfer carrier unit closer to or away from the image carrier, wherein when a sheet-like recording member transport fault is detected, the moving mechanism starts to move the transfer carrier unit away from the image carrier before the transport of the sheet-like recording member by the transfer carrier is stopped.

According to this invention, when the transport fault of the sheet-like recording member is detected, the transfer carrier is separated from the image carrier, thereby separating the sheet-like recording member from the image carrier, and the transport of the sheet-like recording member is stopped after transporting it to the area of the fixing section; as a result, the toner image formed on the image carrier before the occurrence of the jam can be prevented from being transferred to the sheet-like recording member, while also preventing the charged image carrier from adding to the force working to attract the sheet-like recording member to the transfer carrier. This not only serves to reduce the amount of unfixed toner to be transferred to the sheet-like recording member, but also makes it easier to remove the sheet-like recording member from the transfer carrier, and thus the amount of toner smudging on the interior of the apparatus and on the hand handling the sheet-like recording member can be reduced, making the jam handling work easier.

In the invention it is preferable that a plurality of the image carriers are arranged along a direction in which the transfer carrier is rotated, and when a sheet-like recording member transport fault is detected, the moving mechanism starts to move the transfer carrier unit away from the plurality of image carriers before the transport of the sheet-like recording member by the transfer carrier is stopped, and at the same time, of the plurality of image carriers, the image carriers separated from the transfer carrier are caused to stop rotating, after which, of the plurality of image carriers, the image carrier still in contact with the transfer carrier is caused to stop rotating when the transport of the sheet-like recording member by the transfer carrier is stopped.

According to this invention, when the transport fault of the sheet-like recording member is detected, the transfer carrier is separated from the image carriers, thereby separating the sheet-like recording member from the image carriers, and the transport of the sheet-like recording member is stopped after transporting it to the area of the fixing section. During this process, the rotation of the image carriers no longer contacting the sheet-like recording member or the transfer carrier is stopped; since the non-contacting image carriers need not be rotated uselessly, the lifetime of the image carriers can be extended. On the other hand, the image carrier still in contact with the sheet-like recording member or the transfer carrier keeps rotating until the sheet-like recording member or the transfer carrier stops; since the image carrier can thus be prevented from being rubbed against the sheet-like recording member and the transfer carrier, the lifetime of the image carrier can be extended.

In the invention it is preferable that the image forming apparatus comprises a plurality of the image carriers and switching means for selectively switching between a multicolor mode, in which an image is formed using all the image carriers, and a single-color mode, in which an image is formed using a selected one of the image carriers, the image carriers and the transfer carrier being set in a different contacting relationship in one mode than in the other, wherein when a sheet-like recording member transport fault is detected during the formation of an image in the multicolor mode, the switching means thereafter switches the contacting relationship between the transfer carrier and the image carriers to the contacting relationship used in the single-color mode.

According to this invention, when the transport fault of the sheet-like recording member is detected, the contacting relationship between the transfer carrier or the sheet-like recording member and the image carriers is thereafter switched to that used in the single-color mode, so that the mechanism used when switching between the multicolor mode and the single-color mode can be used effectively.

In the invention it is preferable that the image forming apparatus further comprises a transfer member for applying a transfer bias to the transfer carrier, wherein when a sheet-like recording member transport fault is detected, the transfer member cuts off the transfer bias being supplied to the transfer carrier.

According to this invention, when the transport fault of the sheet-like recording member is detected, since the transfer bias being applied to the transfer carrier is thereafter cut off, not only can the toner image formed on the image carrier contacting the sheet-like recording member be prevented from being transferred to the sheet-like recording member, but the transfer bias can be prevented from adding to the attractive force acting between the sheet-like recording member and the transfer carrier; as a result, the amount of unfixed toner to be transferred to the sheet-like recording member can be reduced. At the same time, it becomes easier to remove the sheet-like recording member from the transfer carrier, and thus the amount of toner smudging on the interior of the apparatus and on the hand handling the sheet-like recording member can be reduced, making the jam handling work easier.

BRIEF DESCRIPTION OF THE DRAWINGS

Other and further objects, features, and advantages of the invention will be more explicit from the following detailed description taken with reference to the drawings wherein:

FIG. 7 is a flow chart showing one example of jam handling control;

FIG. 8 is a flow chart showing another example of the jam handling control;

FIG. 13 is a flow chart showing a further example of the jam handling control;

FIG. 14 is a flow chart showing a still further example of the jam handling control;

FIG. 15 is a flow chart showing a yet further example of the jam handling control;

DETAILED DESCRIPTION OF THE PREFERRED EMBODIMENTS

Embodiments of an image forming apparatus according to the invention will be described with reference to the accompanying drawings.

(Image Forming Apparatus)

Figure 1:
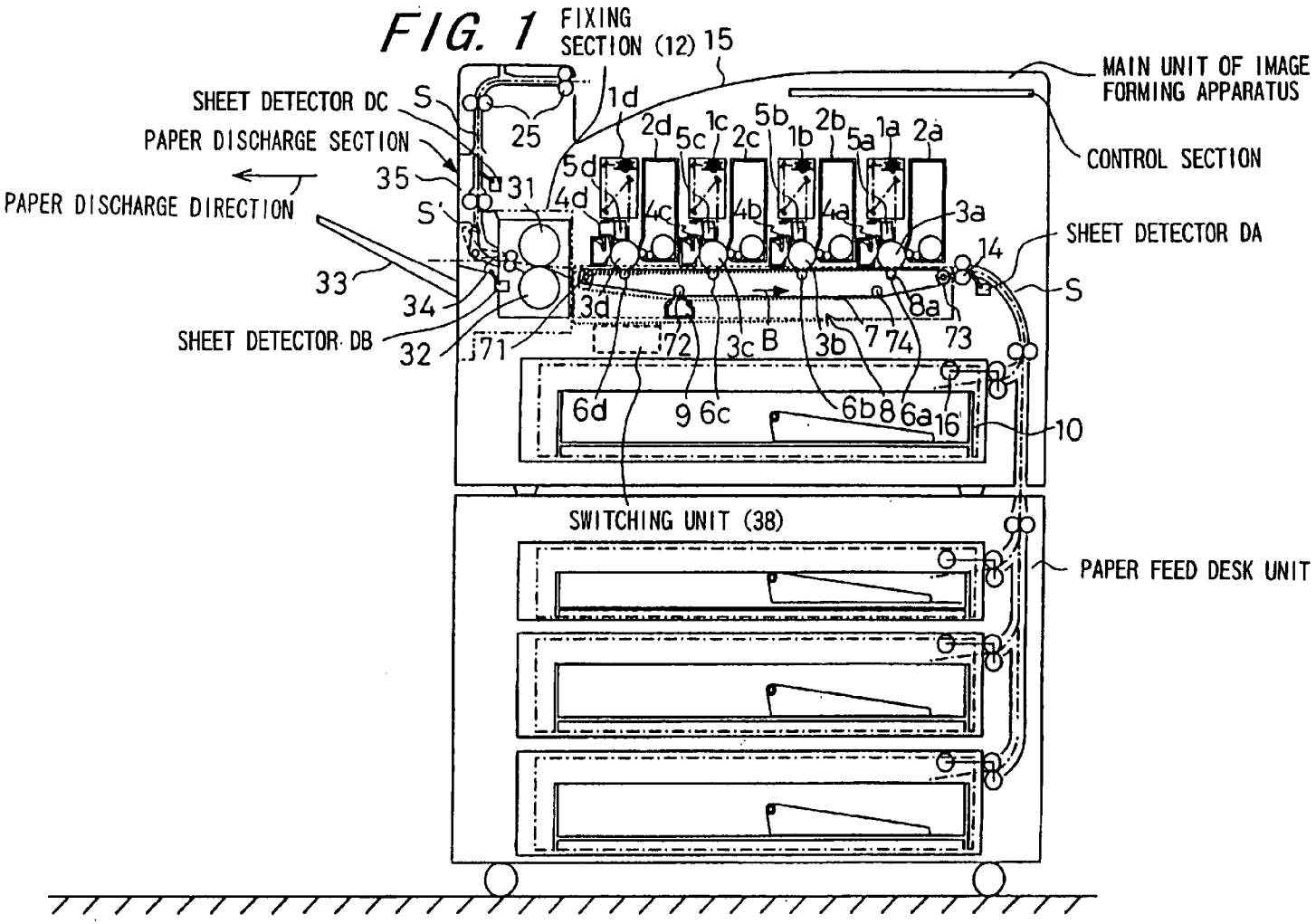
FIG. 1 is a diagram showing the construction of an essential portion of an image forming apparatus according to one embodiment of the invention.

FIG. 1 shows the construction of an image forming apparatus according to one embodiment of the invention. The image forming apparatus shown here forms a multicolor or single-color image on a prescribed sheet-like recording member (recording paper, hereinafter called the sheet) in accordance with externally supplied image data, and the main unit of the image forming apparatus comprises an exposure unit 1, a developer unit 2, a photoconductor drum 3 as an image carrier, a charge unit 5, a cleaner unit 5, a transfer/transport belt unit 8, a fixing unit 12, a paper transport path S, a paper feed tray 10, and a paper discharge tray 15.

The image data used in this image forming apparatus are data for forming color images using black (K), cyan (C), magenta (M), and yellow (Y) colors, respectively. Accordingly, the image forming section of the image forming apparatus comprises four image stations set for the respective colors, black, cyan, magenta, and yellow. To form latent images and visible images corresponding to the respective colors, the image stations include exposure units 1*a*, 1*b*, 1*c*, and 1*d* (hereinafter sometimes collectively referred to as the exposure unit 1), developer units 2*a*, 2*b*, 2*c*, and 2*d* (hereinafter sometimes collectively referred to as the developer unit 2), photoconductor drums 3*a*, 3*b*, 3*c*, and 3*d* (hereinafter sometimes collectively referred to as the photoconductor drum 3), charge units 5*a*, 5*b*, 5*c*, and 5*d* (hereinafter sometimes collectively referred to as the charge unit 5), and cleaner units 4*a*, 4*b*, 4*c*, and 4*d* (hereinafter sometimes collectively referred to as the cleaner unit 4), respectively. To explain the suffixes to the reference numerals, "a" indicates black, "b" cyan, "c" magenta, and "d" yellow. That is, the image forming apparatus contains four exposure units 1, four developer units 2, four photoconductor drums 3, four charge units 5, and four cleaner units 4.

The photoconductor drum 3 is substantially centralized in the image forming apparatus. The charge unit 5 is charging means for uniformly charging the surface of the photoconductor drum 3 to a prescribed potential; a corona-wire type charge unit such as shown in the drawing or a contact roller or brush type charge unit can be used as the charge unit.

The exposure unit 1 is constructed, for example, from an LED write head consisting of an array of light-emitting devices or, as shown in the drawing, from a laser scanning unit (LSU) comprising a laser emitting part and a reflective mirror. The photoconductor drum 3 charged by the charge unit 5 is exposed by the exposure unit 1 to the light corresponding to the input image data, thereby forming on the surface thereof an electrostatic latent image corresponding to the image data.

The developer unit 2 makes the electrostatic latent image formed on the photoconductor drum 3 visible by applying toner of the corresponding color (K, C, M, or Y). The cleaner unit 4 removes and collects the toner remaining on the photoconductor drum surface after the developing and image transfer steps.

The transfer/transport unit 8 disposed below the photoconductor drums 3 comprises a transfer belt 7, a transfer belt driving roller 71, a transfer belt tension roller 73, a plurality of transfer belt driven rollers 72 and 74, transfer rollers 6*a*, 6*b*, 6*c*, and 6*d* (hereinafter sometimes collectively referred to as the transfer roller 6), and a transfer belt cleaning unit 9. The transfer belt 7 is run around the transfer belt driving roller 71, transfer belt driven rollers 72 and 74, and transfer belt tension roller 73 and, with these rollers 71, 72, 73, and 74, the transfer belt 7 is driven for rotation in the direction indicated by arrow B.

The transfer rollers 6, each rotatably supported on a shaft (not shown) mounted in a housing (not shown) inside the transfer/transport unit 8, are arranged one spaced a prescribed distance apart from another between the transfer belt driving roller 71 and the transfer belt tension roller 73. The transfer belt 7 run around the transfer belt driving roller 71, transfer belt driven rollers 72 and 74, and transfer belt tension roller 73 is supported from the underside thereof by the transfer rollers 6. The transfer rollers 6 cause the toner images formed on the respective photoconductor drums 3 to be transferred to the sheet while the sheet is transported by the transfer belt 7 by being attracted to it.

The transfer belt 7 is an endless belt formed from film with a thickness of about 100 to 150 $\mu$m, and is made so that it can be brought into contact with and be separated from the respective photoconductor drums 3. In a multicolor mode in which the image formation is performed by bringing the transfer belt 7 into contact with all the photoconductor drums 3, the toner images formed in the respective colors on the respective photoconductor drums 3 are sequentially transferred one overlaid on top of another to the sheet to form a color toner image, that is, a multicolor toner image thereon.

On the other hand, in a single-color mode in which the transfer belt 7 is brought into contact only with the photoconductor drum 3*a* for image formation but is separated from the other photoconductor drums 3*b*, 3*c*, and 3*d*, the black toner image, that is, a single-color image, is transferred to the sheet to form a black and white image thereon.

Figure 17:
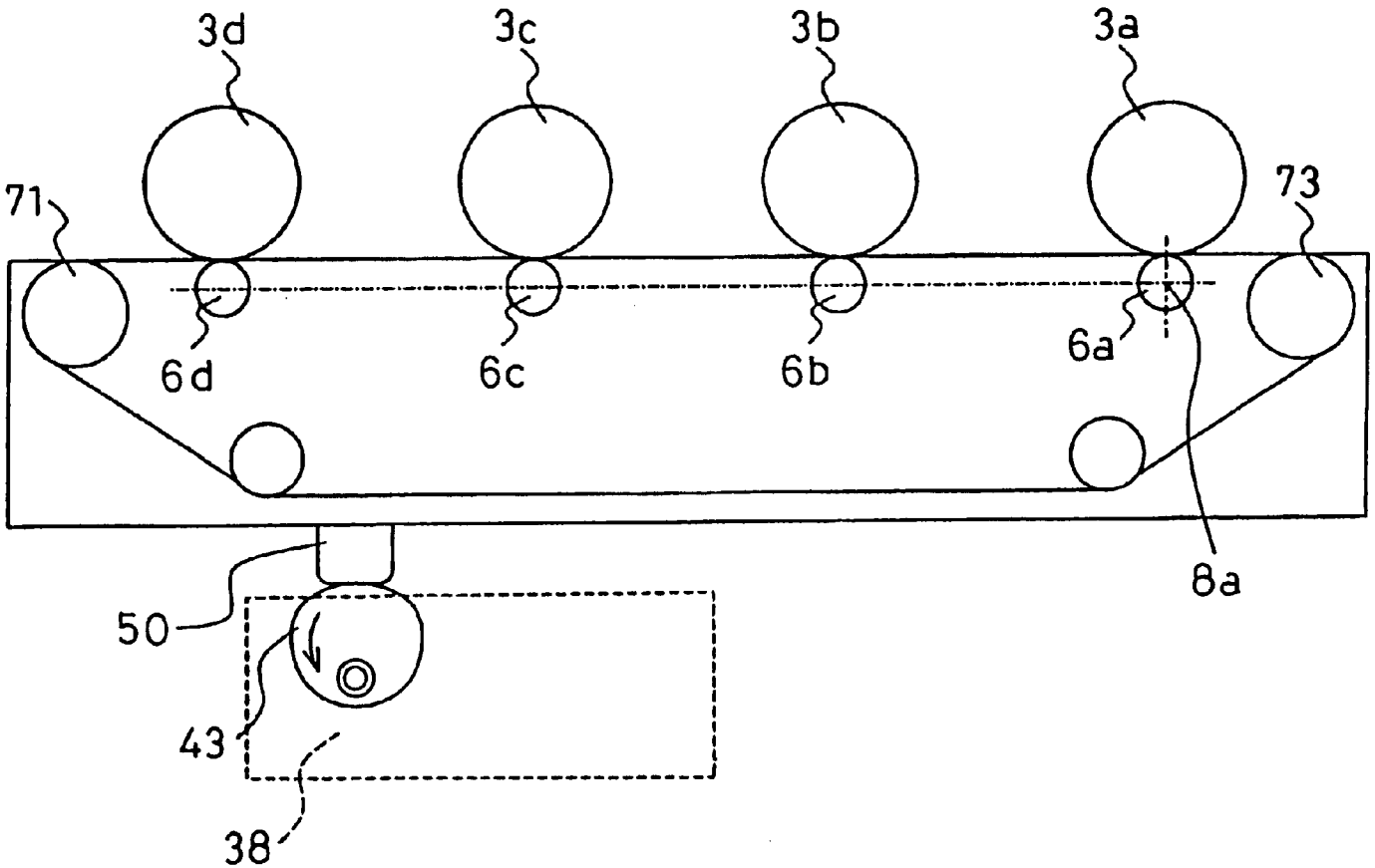
FIG. 17 is a diagram showing the condition in a multicolor mode.
Figure 18:
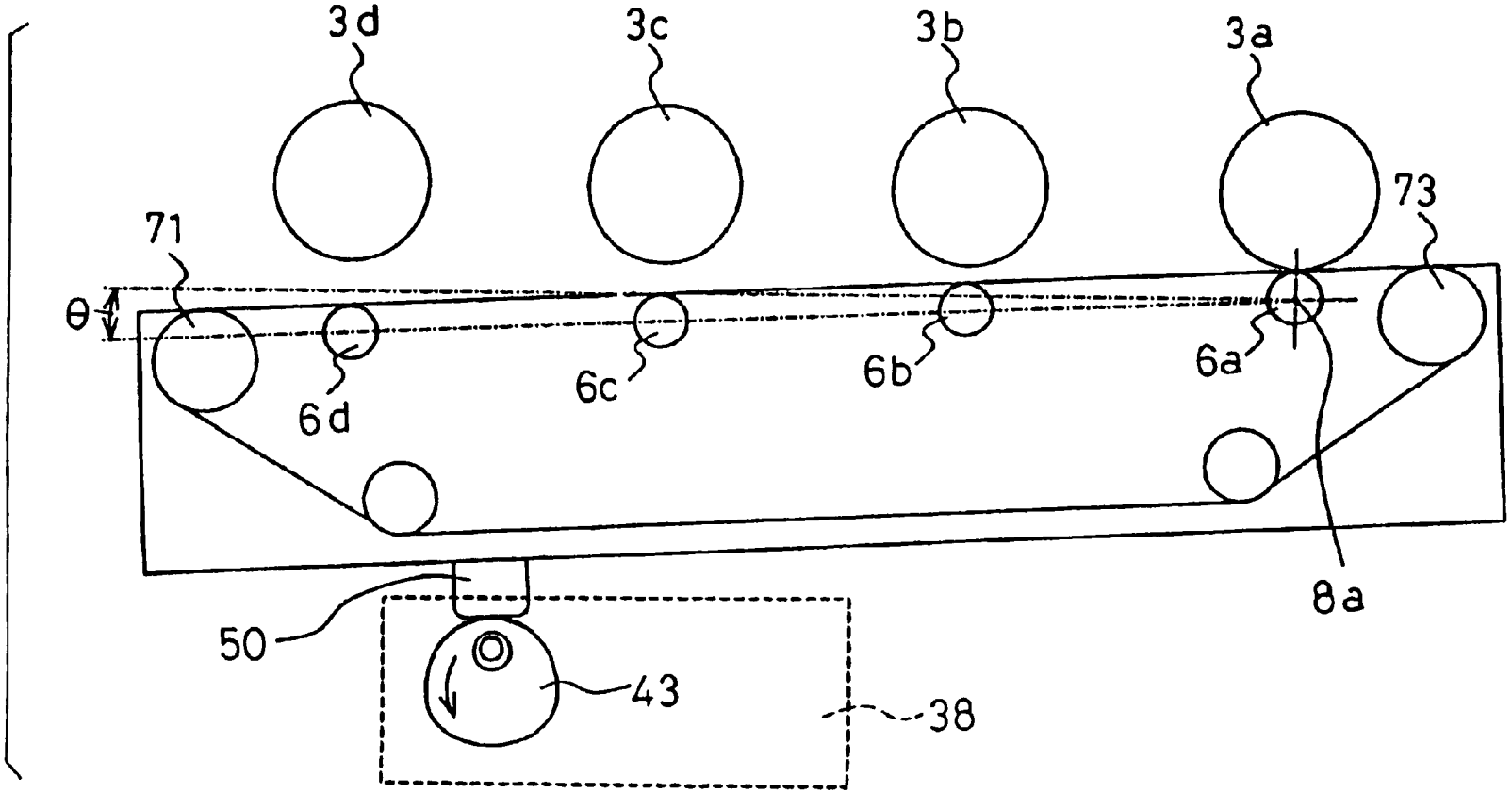
FIG. 18 is a diagram showing the condition in a single-color mode.

Switching the transfer belt 7 between the two modes is performed using a switching unit 38 which is switching means. More specifically, as shown in FIGS. 1, 17, and 18, a cam 43 provided in the switching unit 38 is rotated by a driving source such as a stepping motor not shown; this rotational motion gives an up/down motion to a support piece 50 provided on the transfer/transport unit 8, and the transfer/transport unit 8 is thus turned about a support shaft 8*a* whose axis lies on the extended line of the axis of the shaft of the transfer roller 6*a* that is mounted in the housing of the transfer/transport unit 8.

Figure 3:
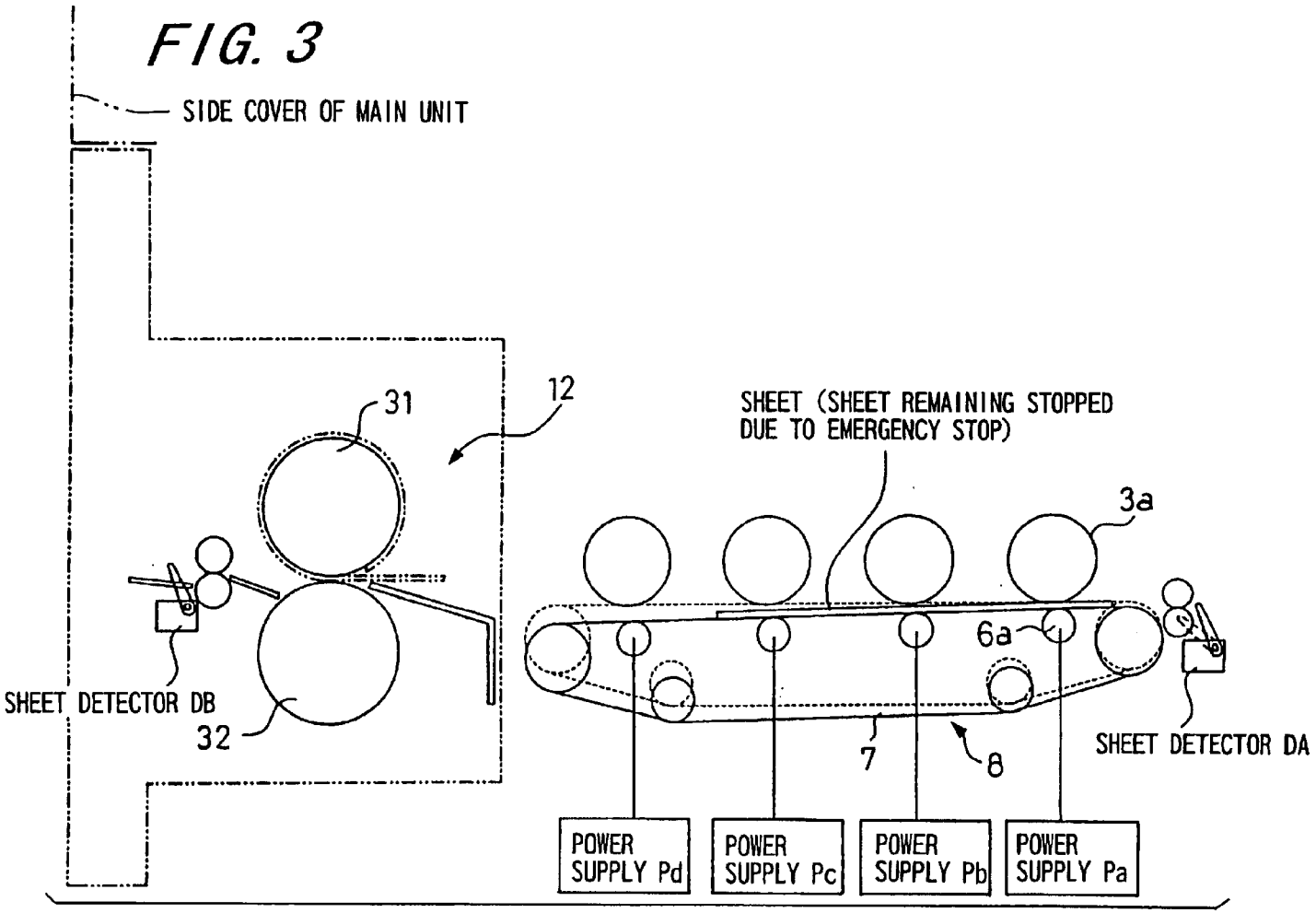
FIG. 3 is a diagram for explaining an emergency stop condition.

Referring to FIG. 3, the transfer of the toner images from the photoconductor drums 3 to the sheet is performed by the respective transfer rollers 6 contacting the underside of the transfer belt 7. In the transfer section, high-voltage power supplies Pa, Pb, Pc, and Pd supply the respective transfer rollers 6*a*, 6*b*, 6*c*, and 6*d* with a high voltage, for example, a high voltage of polarity (+) opposite to the polarity (−) of the charged toner, for transferring the toner images or with an AC high voltage for eliminating the charges on the transfer belt 7 when the sheet gets jammed during transport. Each transfer roller 6 is a conductive elastic member formed using EPDM or foamed urethane or the like as a base material and a conductive material as a filler, and mounted on a metal (for example, stainless steel) shaft 8 to 10 mm in diameter. Therefore, the surface of the elastic member has electrical conductivity. With this conductive elastic member, a high voltage can be applied uniformly to the sheet.

The transfer belt cleaning unit 9 removes and collects any remaining toner attracted from the respective photoconductor drums 3 to the transfer belt 7 because such toner can smear the back surface of the sheet.

The paper feed tray 10 is a tray for storing sheets (recording paper) to be used for printing, and is mounted below the image forming section of the image forming apparatus. The paper discharge tray 15 located in the top of the image forming apparatus is a tray for receiving printed sheets face down. The paper discharge tray 33 mounted in one side of the image forming apparatus is a tray for receiving printed sheets face up.

The image forming apparatus also includes an S-shaped paper transport path S along which the sheet is transported from the paper feed tray 10 to the paper discharge tray 15 by passing through the transfer/transport unit 8 and the fixing section 12, i.e., the fixing unit. Along the paper transport path S from the paper feed tray 10 to the paper discharge trays 15 and 33 are arranged a pickup roller 16, resist rollers 14, the fixing section 12, a transport direction switching gate 34, transport rollers 25, etc.

The transport rollers 25 are small-size rollers for facilitating and assisting the transport of the sheet, and are provided at a plurality of locations along the paper transport path S. The pickup roller 16 is provided at an edge of the paper feed tray 10, and takes up one sheet at a time from the paper feed tray 10 and feeds it into the paper transport path S.

The transport direction switching gate 34 is turnably mounted in a side cover 35; when the switching gate 34 is turned from the position indicated by a solid line to the position indicated by a dashed line, the sheet is separated partway through the transport path S so that the sheet can be fed out onto the paper discharge tray 33 mounted in one side of the image forming apparatus.

On the other hand, when the switching gate 34 is set in the position indicated by the solid line, the sheet is passed through the fixing unit 12 and through a transport path S', a portion of the paper transport path S, formed between the side cover 35 and the transport switching guide 34, and is fed out onto the top discharge tray 15.

The resist rollers 14 are rollers for temporarily holding the sheet being transported along the paper transport path S. These rollers have the function of advancing the sheet by synchronizing the roller action to the rotation of the photoconductor drums 3 so that the toner images on the respective photoconductor drums 3 can be properly transferred one on top of another onto the sheet.

More specifically, based on a detection signal from a sheet detector DA, the resist rollers 14 are set to feed the sheet so that the lead edge of the printable area of the sheet is aligned with the lead edge of the toner image on each photoconductor drum 3. The sheet detector DA is also used to monitor the sheet transport timing, and a sheet jam, for example, is detected based on the signal from the sheet detector DA.

The fixing section 12 comprises a heat roller 31 and a pressure roller 32 which rotate by sandwiching a sheet between them. The heat roller 31 is maintained at a prescribed fixing temperature by a control unit for controlling on/off operation of a heater lamp (not shown) based on an output value from a temperature sensor not shown. The heat roller 31 has the function of thermally fixing the toner image onto the sheet by pressing the sheet with heat against the pressure roller 32 and thereby melting, mixing, and pressing the single-color or multicolor toner image transferred to the sheet. The heat roller 31 and the pressure roller 32 are hereinafter referred to as the roller members 31 and 32 of the fixing section.

After the toner image is fixed, the sheet is transported by the transport rollers 25 and fed out onto the paper discharge tray 33 or 15, whichever is selected. When the sheet is fed into the reversing paper discharge path, i.e., the paper discharge section, of the paper transport path S, the sheet is turned over, and is fed out onto the paper discharge tray 15 with the toner image side facing down. At this time, the sheet transport condition after the fixing is monitored by sheet detectors DB and DC and other sheet detectors, etc. not shown.

The above description has dealt with a color image forming apparatus, but the invention is also applicable to a monochrome image forming apparatus, the type of image forming apparatus equipped with only one image forming station. Further, in the present embodiment, the main unit of the image forming apparatus is mounted on a paper feed desk unit comprising three paper feed trays stacked one on top of another, but the construction is not limited to the illustrated example, and various types of paper feed unit may be selected by the user.

In the above image forming apparatus, in order to efficiently and reliably handle a paper jam, i.e., a transport jam, occurring during the transport of a sheet, the present embodiment includes a control section having jam handling control means for detecting a sheet transport fault and for stopping the transport operation when a transport fault is detected. The construction of the control section will be described below.

Figure 2:
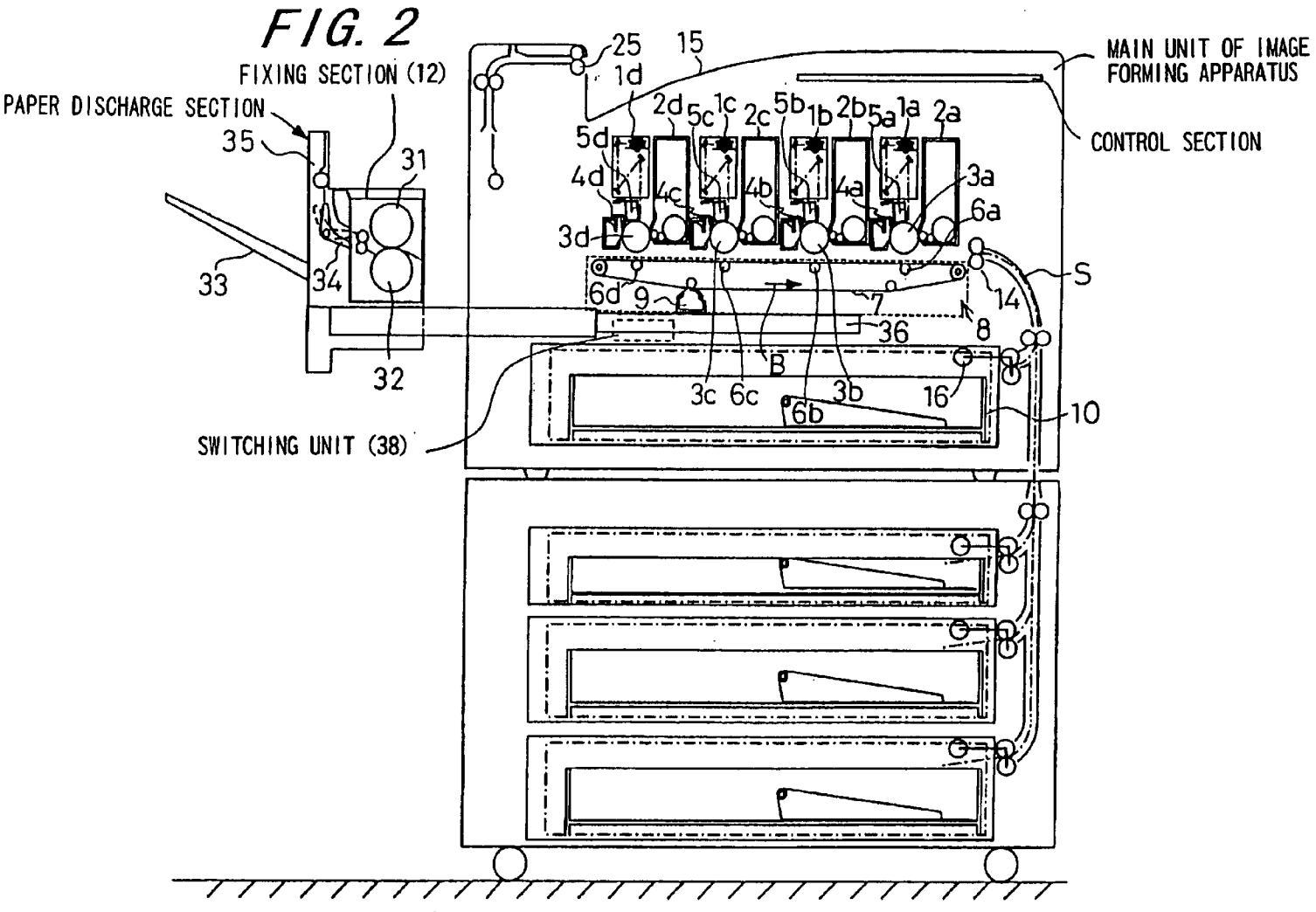
FIG. 2 is a diagram showing the construction of the essential portion, illustrating the condition in which a fixing section of the image forming apparatus of FIG. 1 is drawn out.
Figure 16:
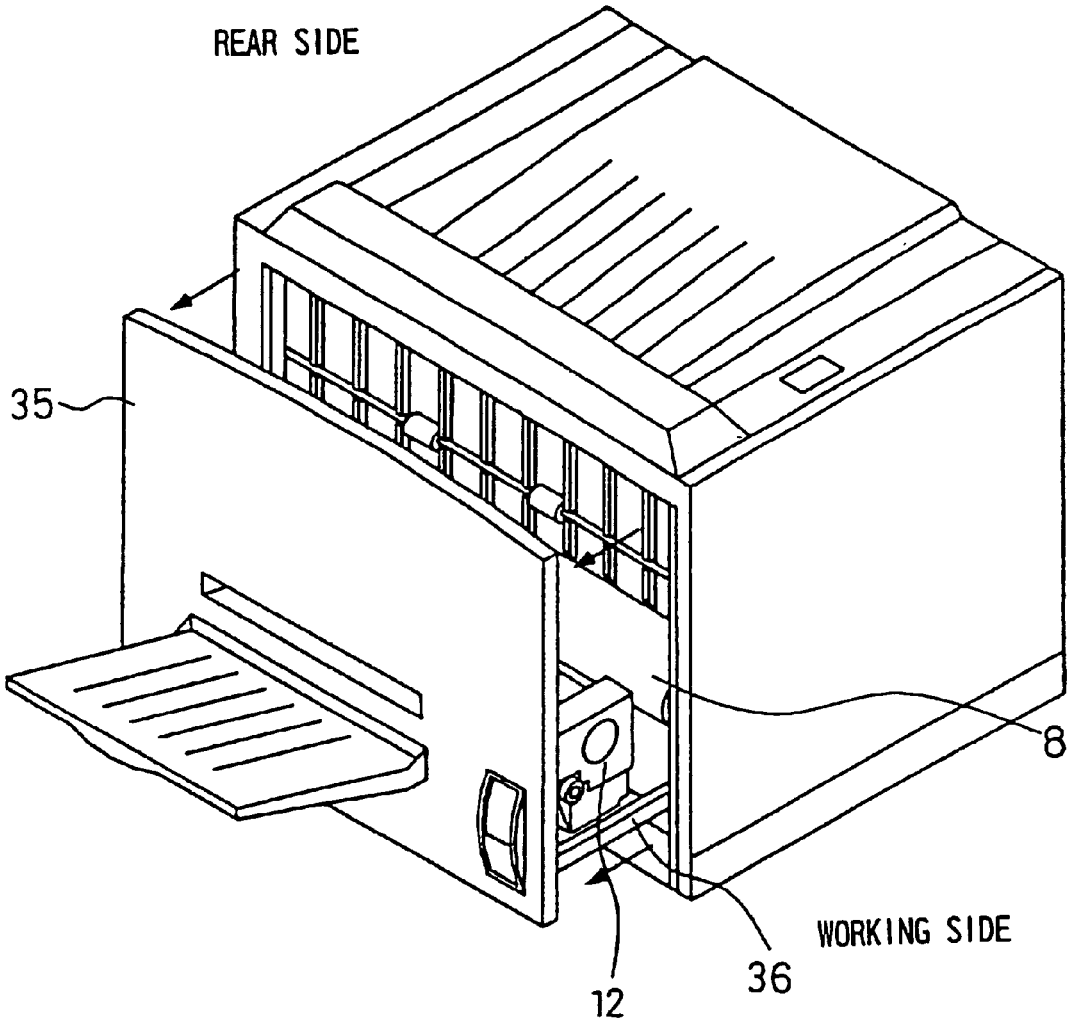
FIG. 16 is a diagram for explaining the condition in which the fixing section is drawn out for jam handling.

As shown in FIG. 2, the fixing section 12 unitized with the paper discharge section having the paper discharge tray 33 is mounted on slide members 36 provided along both sides of the main unit of the image forming apparatus so that the fixing section 12 can be drawn out of the main unit toward the transport downstream direction, i.e., the sheet transport direction of the transfer/transport belt unit 8 (see FIG. 16). When handling a jam, the fixing section 12 together with the side cover 35 is drawn out of the main unit of the image forming apparatus, in interlocking fashion with which the cam mechanism (not shown) provided on the slide members 36 is caused to engage with the transfer/transport unit 8 and the switching unit 38, thereby separating the transfer belt 7 from all the photoconductor drums 3; when the fixing section 12 is pushed back into its original position, the transfer belt 7 returns to its original position in interlocking fashion with the push back action. That is, in the present embodiment, the image forming apparatus includes a moving mechanism (not shown) for moving the transfer belt unit 8 as a transfer carrier unit in such a manner that the transfer belt 7 supported in the transfer belt unit 8 is separated from or is brought into contact with all the photoconductor drums 3*a* to 3*d*; that is, the apparatus is constructed so that, to facilitate recovery work, the transfer belt unit 8 can be moved away from all the photoconductor drums 3*a* to 3*d* by mechanically interlocking with the sliding action (see FIG. 16) of the slide members 36 moving integrally with the fixing section 12.

Preferably, the slide members 36 are constructed using high-precision slide bearings such as Accuride (registered trademark) so that the relatively heavy fixing section 12 can be supported thereon with high precision and be moved smoothly; however, other slide means may be used as long as the slide members can ensure highly precise positioning when the fixing unit 12 is moved back into its original position in the main unit of the image forming apparatus.

Further, in the present embodiment, the transfer/transport unit 8 including the transfer belt 7 is supported in the main unit of the image forming apparatus in such a manner that the downstream side of the transfer/transport unit 8 can be lifted and lowered by turning the unit 8 about the support shaft 8*a* provided in the housing of the transfer/transport unit 8 and located on the extended line of the axis of the shaft of the upstream-side transfer roller 6*a*, as previously described; in this way, the transfer/transport belt unit 8 can be switched by the switching unit 38 between the condition shown in FIG. 17, in which the transfer belt 7 is held in a substantially horizontal position in contact with all the photoconductor drums 3, and the condition shown in FIG. 18, in which the downstream side of the unit 8 is lowered and only the photoconductor drum 3*a* contacts the transfer belt 7.

In addition to the sheet detectors DA, DB, and DC, similar sheet detectors are provided at a plurality of positions along the transport path S as the detecting means for detecting the position of the sheet being transported.

The control performed by the jam handling control means based on the detection timing of the sheet detector DA disposed on the upstream side of the fixing unit 12 will be described later with reference to the flow charts of FIGS. 7, 8, 13, 14, and 15; on the other hand, the sheet detectors DB and DC disposed on the downstream side of the fixing unit 12 detect the discharge condition of the sheet being fed out onto the paper discharge tray 33 or 15, and similar control can be performed by using the sheet detectors DB and DC in addition to the sheet detector DA.

Figure 12:
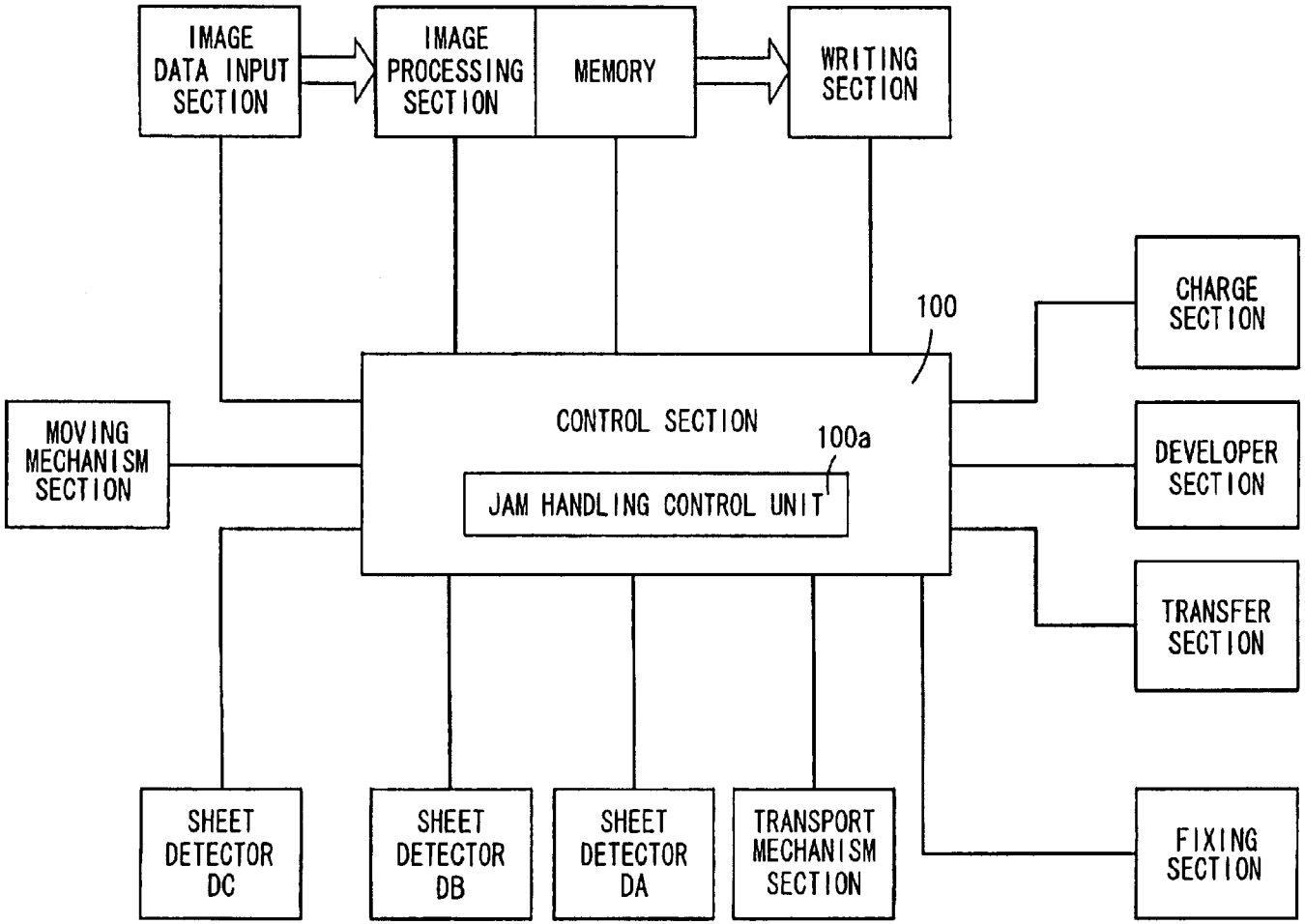
FIG. 12 is a block diagram showing the electrical configuration of a control system.

As shown in FIG. 12 showing the control system block diagram of the image forming apparatus, the jam handling control means is provided as a jam handling control unit 100*a* within the control section comprising a CPU, ROM, and RAM; on the input side of the control unit are connected the sheet detectors DA, DB, and DC, while on the output side are connected the transport mechanism section comprising a driving source for driving the transfer belt 7, a clutch for the resist rollers 14 as sheet transport means on the upstream side of the transfer belt 7, etc. and the moving mechanism section (switching unit 38) for moving the transfer belt unit 8 closer to and away from the photoconductor drums 3*a* to 3*d*, as well as the transfer member (contained in the transfer section) for applying a high-voltage transfer bias to the transfer rollers 6. In the invention, the sheet transport means on the upstream side of the transfer belt 7 is not limited to the resist rollers 14, but in addition to that, the sheet transport rollers provided along the transport path S on the upstream side of the transfer belt 7 may also be included in the sheet transport means.

For jam handling, as previously described, the fixing section 12 is drawn out of the main unit of the image forming apparatus to expose the fixing section 12 outside so that the jammed sheet can be removed by working from the front and rear and from both sides of the fixing unit 12; however, since the exposed section allows an access only from one side to the image forming section where a jam occurred, if any sheet remains stopped between the photoconductor drum 3 and the transfer belt 7 on the upstream side, it is often difficult to find such remaining sheet.

In particular, small-size sheets are often left unnoticed. In view of this, the jam handling control means performs the following control during jam handling so that any sheet remaining stopped in such a hard-to-find position on the upstream side can be found and removed reliably. The jam handling process described below concerns the control performed when handling a jam in a multicolor mode in which all the photoconductor drums 3 are used for image formation.

For example, as shown in the flow chart of FIG. 7, after an image forming operation is started in step S1, if a transport jam is detected in step S2, all the operations relating to the image formation (such as write operation to the photoconductor drums 3 by the respective exposure units 1, rotating operation of the photoconductor drums 3, charge operation by the charge units 5, developing operation by the developer units 2, transfer bias application operation by the transfer rollers 6, transport operation of the sheet-like recording member, and fixing operation of the fixing section) are immediately stopped in step S4 under the control of the jam handling control unit 100*a*, and in step S4, the jam handling control unit 100*a* activates the switching unit 38 to turn the transfer/transport unit 8 in such a manner as to separate the transfer belt 7 from all the photoconductor drums 3*b*, 3*c*, and 3*d* excluding the photoconductor drum 3*a*.

The reason that the transfer belt 7 is separated from the photoconductor drums 3 is to cut the supply of the charges from the photoconductor drums 3*b*, 3*c*, and 3*d* that are also acting to attract the sheet to the transfer belt 7, and thereby to minimize the force necessary to remove the sheet from the transfer belt 7 in a subsequent step.

Figure 5:
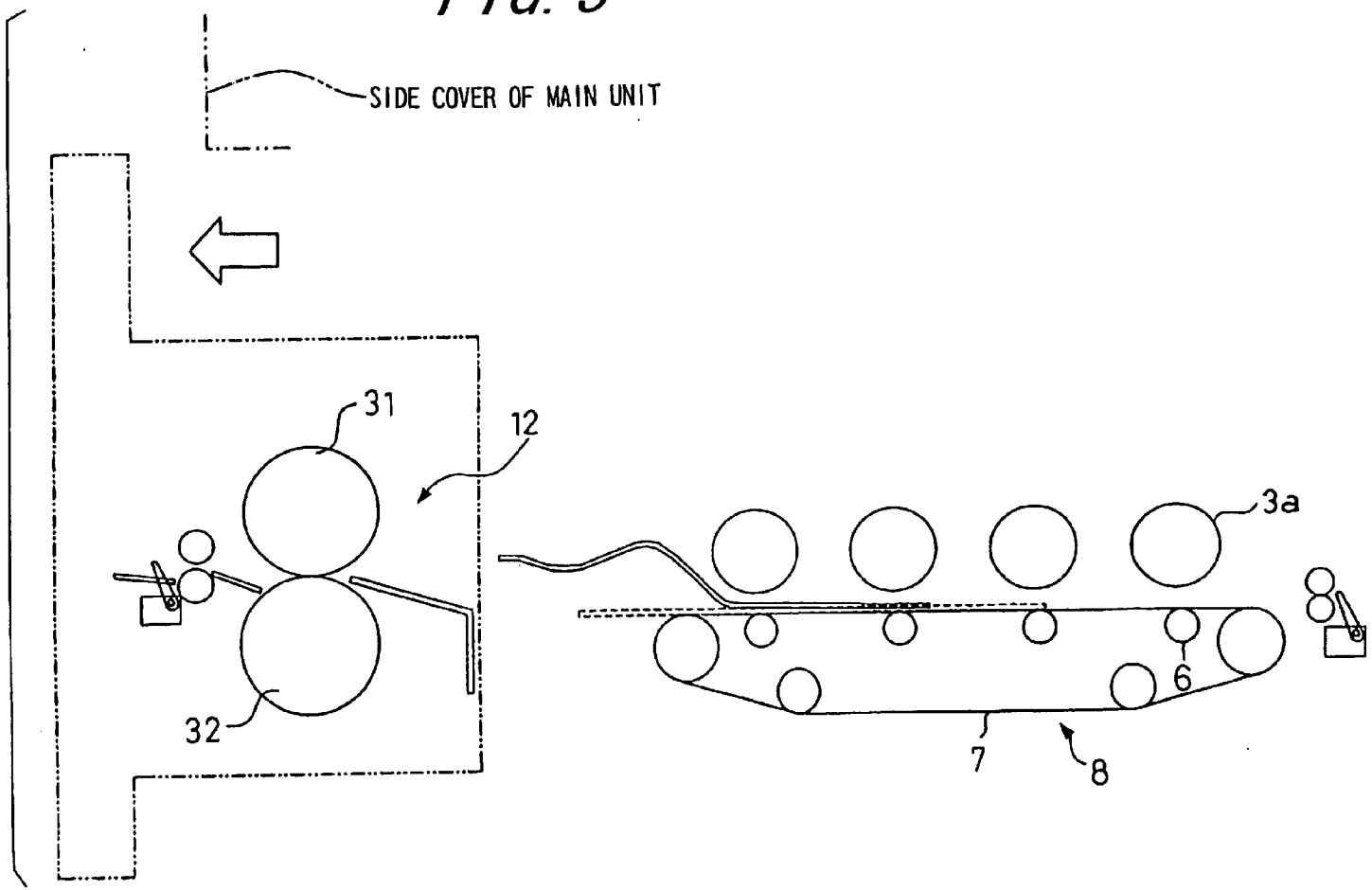
FIG. 5 is a diagram for explaining jam handling performed by drawing out the fixing section.

Thereafter, in step S5, a jam indication is produced on the operation panel under the control of the jam handling control unit 100*a*, and the operator performs the jam handling (recovery work). In the recovery work, the fixing section 12 is drawn out of the main unit of the image forming apparatus, causing the transfer/transport belt unit 8 to move further and thus completely separating the transfer belt 7 from the photoconductor drum 3*a* by the action of the moving mechanism. With this recovery work, the sheet wrapped around the heat roller 31, for example, as shown in FIG. 3, can be removed. The completely separated condition is shown in FIGS. 5 and 9B.

The control described in the above jam handling process is performed when it is determined that the sheet is jammed in the fixing section 12, for example, because the sheet has not reached the detector (for example, the sheet detector DB) located on the downstream side of the fixing unit. When the jam handling is completed, the fixing section 12 is pushed back into the main unit of the image forming apparatus to restore the transfer/transport belt unit 8 to the same condition as it was before the fixing section 12 was drawn out. In step S3, the fixing operation of the fixing section also includes the operation of the heater, and power to the heater is turned off for safety.

Figure 4:
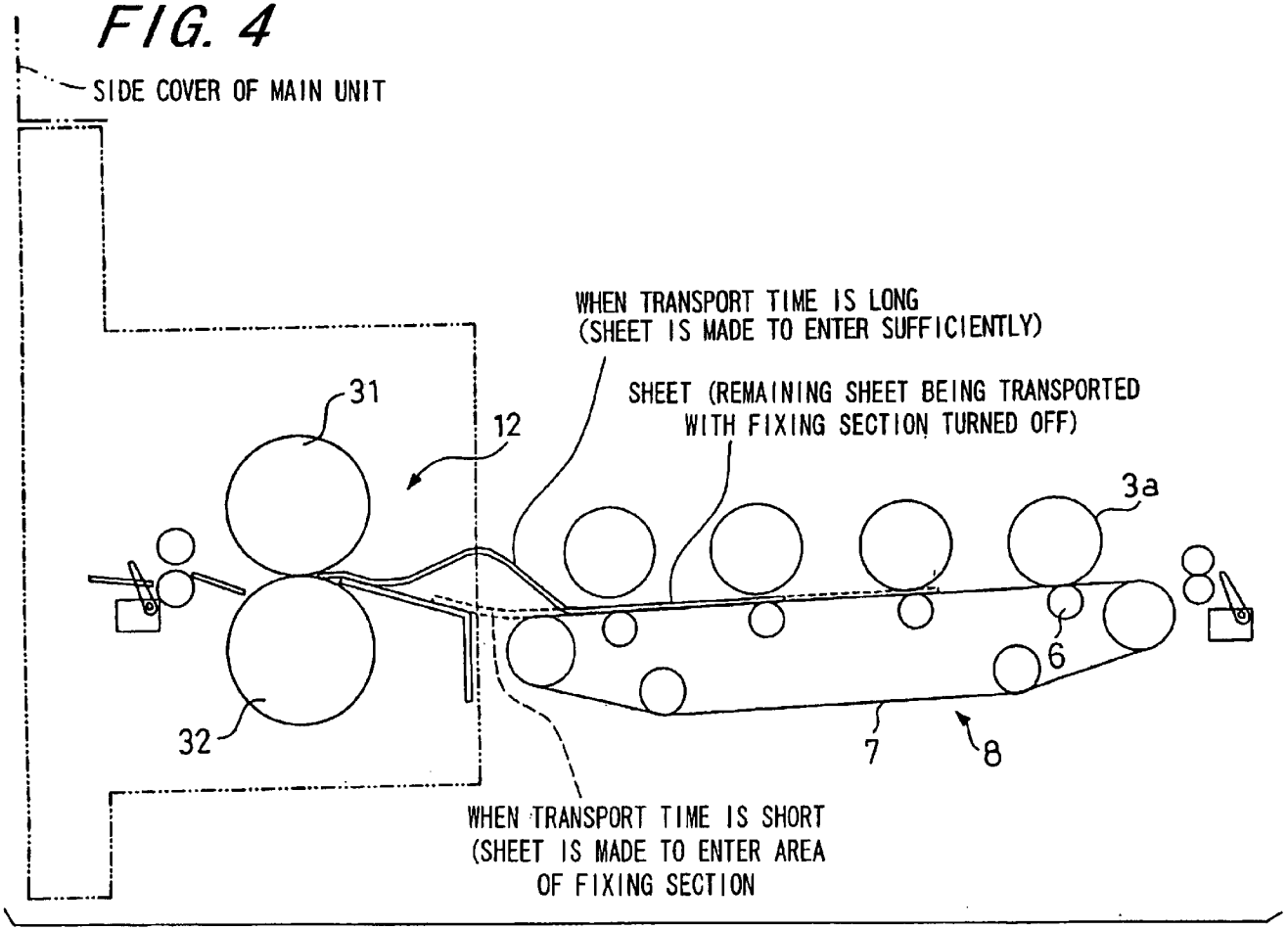
FIG. 4 is a diagram for explaining the condition of a sheet-like recording member remaining when an emergency stop occurs.

Next, in step S6, based on the information obtained by monitoring the condition of the sheet detector DA when the above jam occurred, it is determined by the jam handling control unit 100*a* whether any other sheet that passed by the sheet detector DA is remaining on the transfer belt. Further, in step S7, it is determined by the jam handling control unit 100*a* whether any sheet held between the resist rollers 14 is detected by the sheet detector DA. If it is determined in step S6 or S7 that there remains such a sheet, then in step S8 the jam handling control unit 100*a* causes the sheet transport operation to start while keeping the operation of the fixing section 12 stopped, and in step S9, the sheet transport operation is stopped when the sheet has just entered the area of the fixing section 12 (the sheet condition shown by a dotted line in FIG. 4) or sufficiently entered the area (the sheet condition shown by a solid line in FIG. 4). At this time, the transfer belt 7 is held separated from the photoconductor drums 3 to cut the supply of the charges from the photoconductor drums 3*b*, 3*c*, and 3*d* that are also acting to attract the sheet to the transfer belt 7. This is to minimize the force necessary to remove the sheet from the transfer belt 7 in a subsequent step.

In the present embodiment, the attractive force acting between the transfer sheet 7 and the transfer belt 7 is reduced by stopping the application of the high-voltage transfer bias to the transfer rollers 6, but to actively reduce the attractive force, the power supplies Pb, Pc, and Pd may be switched to an AC high-voltage output for application to the respective transfer rollers 6*b*, 6*c*, and 6*d*. After that, in step S10, the operator draws out the fixing section 12 and performs the jam handling (recovery work) once again.

At this time, since the transfer belt unit 8 is separated from all the photoconductor drums 3 by the action of the moving mechanism in interlocking fashion with the drawing out action of the fixing section 12, the remaining jammed sheet can be removed easily by grabbing the lead edge thereof. Furthermore, since, upon detection of the jam, the application of the transfer bias to the transfer rollers 6 is stopped and the transfer belt 7 is separated from the photoconductor drums 3*b*, 3*c*, and 3*d*, the force working to attract the sheet to the transfer belt is reduced, making it easier to remove the sheet from the transfer belt 7. This also greatly contributes to facilitating the jam handling.

When the fixing section 12 is moved back into its original position after the jam handling, the process returns to step S7 to determine again whether any other remaining sheet is detected by the sheet detector DA; if it is determined by the jam handling control unit 100*a* that there is no remaining sheet, the process proceeds to step S11 where the jam handling control unit 100*a* activates the switching unit 38 to bring the transfer belt 7 into contact with all the photoconductor drums 3. After that, in step S12, preliminary operations of the process section, i.e., preparatory rotation operations (preparatory operations such as the cleaning of the photoconductor drums 3 and the transfer belt 7) are started under the control of the jam handling control unit 100*a*, and when the preparatory rotation operations are completed in step S13, a ready lamp on the operation panel is turned on in step S14, and the image forming apparatus is thus set in the standby mode ready for image formation.

On the other hand, if in step S6 it is determined by the jam handling control unit 100*a* that there is no sheet remaining on the transfer belt, and if any sheet is not detected by the sheet detector DA in step S7, the jam handling control unit 100*a* determines that the jam handling has been completed, and the process proceeds to step S11 where the switching unit 38 is activated to bring the transfer belt 7 into contact with all the photoconductor drums 3. After that, the process proceeds to steps S12 and S13; upon completion of the preparatory rotation operations, the jam handling control unit 100*a* in step S14 turns on the ready lamp indicating that the image forming apparatus is ready for operation. In this embodiment, the ready lamp is turned on to prompt the operator to resume the image forming operation, but instead, the image forming operation may be resumed automatically.

As described above, after the jam has been handled by drawing out the fixing section 12 out of the main unit of the image forming apparatus, if there is any succeeding sheet remaining in the upstream part of the image forming apparatus, the jam handling is performed once again by transporting the sheet to an easy-to-retrieve position; in this way, any remaining sheet can be removed and the recovery work completed in a reliable manner. The easy-to-retrieve position here is a position where the sheet lies extending from the area of the transfer belt 7 into the area of the fixing section 12.

When it is determined that a transport jam has occurred, in the upstream-side sheet transport means the resist rollers 14 and the sheet transport means on the upstream side thereof are stopped. However, if there is any sheet that is held between the resist rollers 14 and whose lead edge is lying in the area of the transfer belt 7, the sheet is transported until its lead edge just enters or sufficiently enters the area of the fixing section. At this time, the resist rollers 14 are driven for rotation by the action of a one-way clutch (not shown) provided between the driving-side resist roller 14 and a drive unit not shown. Further, the upstream-side rollers, including the resist rollers 14, where the sheet is held, may also be driven.

Figure 6A:
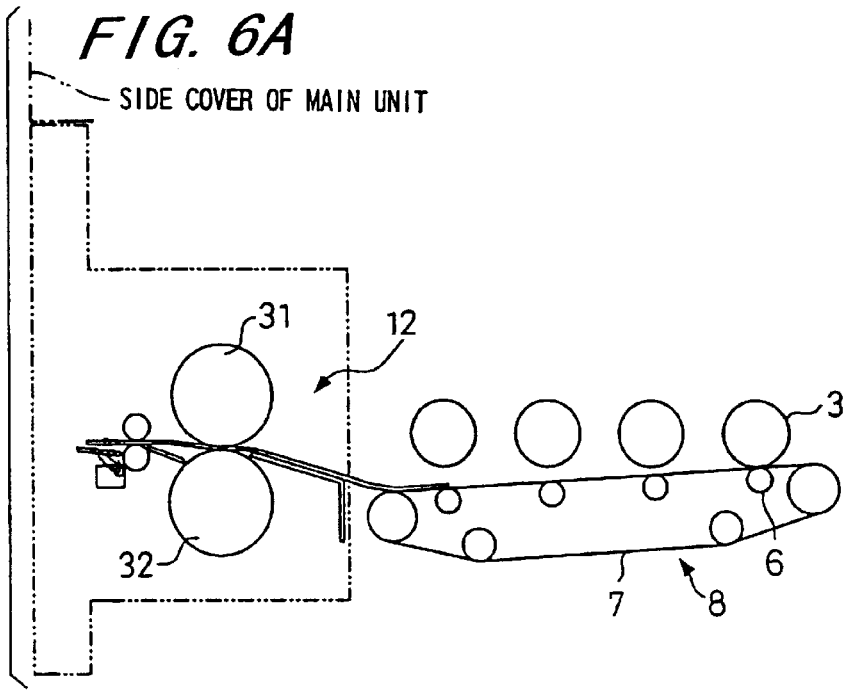
FIGS. 6A and 6B are diagrams for explaining another example of the jam handling.
Figure 6B:
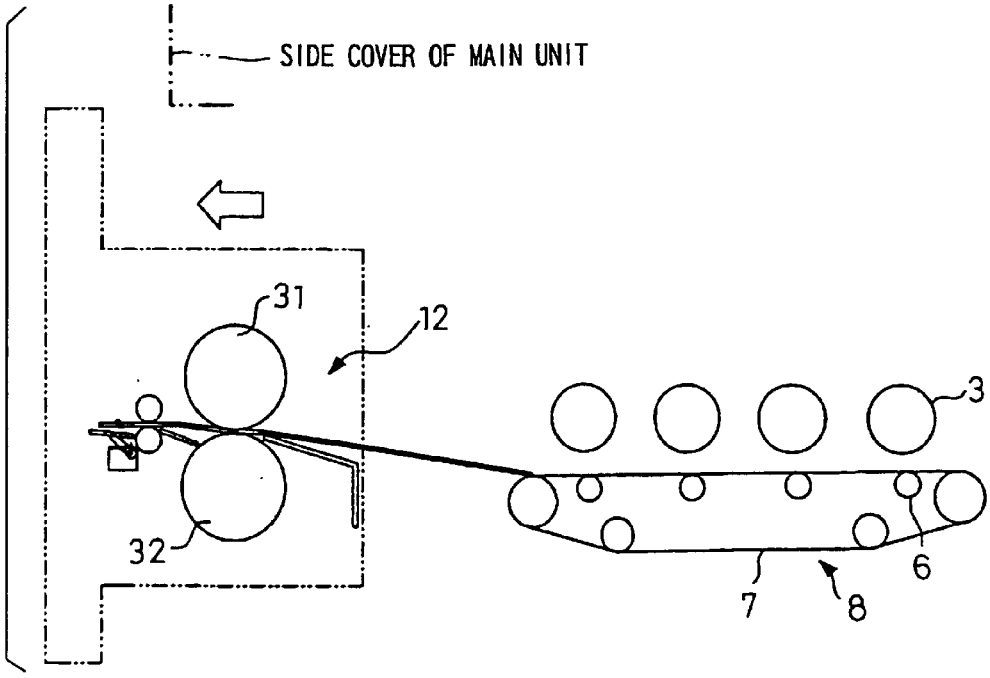

In the second jam handing operation described above, the following provisions may be made in order to ensure further reliable transport of the succeeding sheet stopped in the upstream part at the time of an emergency stop; that is, as shown in FIG. 8, when starting the sheet transport operation, the rotating operation of the fixing section 12 is also started in step S8', and before stopping the sheet transport operation, the transfer belt 7 is rotated for a prescribed time, for example, for a time equal to the time required to feed the sheet between the fixing rollers (roller members) 31 and 32 as shown in FIG. 6A, after which the sheet transport operation is stopped in step S9, to allow the sheet to be removed. In this case, by drawing the fixing section 12 out of the main unit of the image forming apparatus, the sheet held between the fixing rollers 31 and 32 can be easily pulled out from the inside of the image forming apparatus; in this way, the sheet can be easily removed from the transfer belt 7. By setting the sheet transport steps S8' and S9' as described above, even a small-size sheet can be reliably transported to an easy-to-retrieve position where the sheet is caught between the rollers 31 and 32 of the fixing section 12, without letting the sheet fall somewhere inside the image forming apparatus.

The above jam handling performed over a plurality of times is particularly effective when a jam occurs in the fixing section 12. If such a jam is not handled immediately, the sheet may burn and produce a smoke due to excessive heating, leading to a dangerous situation; therefore, in the above jam handing process, the image forming apparatus is stopped immediately, and the fixing section is drawn out to remove the jammed sheet. In the case of a jam occurring in a section other than the fixing section 12, the jam handling may be performed in a more efficient way.

The following example deals with the case where the rotating operation of the sheet transport means on the upstream side of the fixing section 12 is not stopped immediately when a jam is detected.

For example, as shown in FIG. 13, after an image forming operation is started in step S21, if a jam is detected in step S22, the image forming operation (write operation to the photoconductor drums 3 by the respective exposure units 1, developing operation by the developer units 2, etc.) and the operation of the fixing section (heating operation by the heater, and rotating operation of the rollers 31 and 32) are stopped in step S23 under the control of the jam handling control unit 100*a*. Further, in step S24, the jam handling control unit 100*a* activates the switching unit 38 to turn the transfer/transport unit 8 in such a manner as to separate the transfer belt 7 from the photoconductor drums 3*b*, 3*c*, and 3*d*. The reason for this is, as previously described, to reduce the force working to attract the sheet to the transfer belt 7 as much as possible, thereby facilitating the removal of the sheet from the transfer belt 7, and also to prevent the images already formed on the photoconductor drums 3*b*, 3*c*, and 3*d* from being transferred to the sheet.

At the same time, in step S25, the application of the transfer bias to the transfer rollers 6 is also stopped under the control of the jam handling control unit 100*a*. The reason for this is to reduce the force working to attract the sheet to the transfer belt 7 and also to prevent the image already formed on the photoconductor drum 3*a* from being transferred to the sheet. At this time, the high-voltage being applied to the transfer rollers 6*b*, 6*c*, and 6*d* may be switched to an AC high-voltage output to actively reduce the attractive force, as previously described.

Then, in step S26, the rotation of the photoconductor drums 3*b*, 3*c*, and 3*d* thus separated is stopped under the control of the jam handling control unit 100*a*. The jam handling control unit 100*a* performs control so that the sheet attracted to the transfer belt 7 and carried thereon continues to be transported without contacting the photoconductor drums 3*b*, 3*c*, and 3*d*, and after the sheet has been transported by the transfer belt 7 until the lead edge of the sheet sufficiently enters the area of the fixing section 12 in step S27, the sheet transport operation is stopped in step S28.

The above operation assumes, for example, the case where two sheets are carried on the transfer belt 7 (the condition shown in FIG. 10); in this case, the leading and succeeding sheets are both transported to the position just before the roller members 31 and 32 in the transfer section 12 so that the two sheets can be removed at the same time (at once). At this time, if the succeeding sheet is held between the resist rollers 14, etc. which are the transport means disposed on the downstream side, these roller members are driven to allow the sheet to be transported smoothly.

Figure 9A:
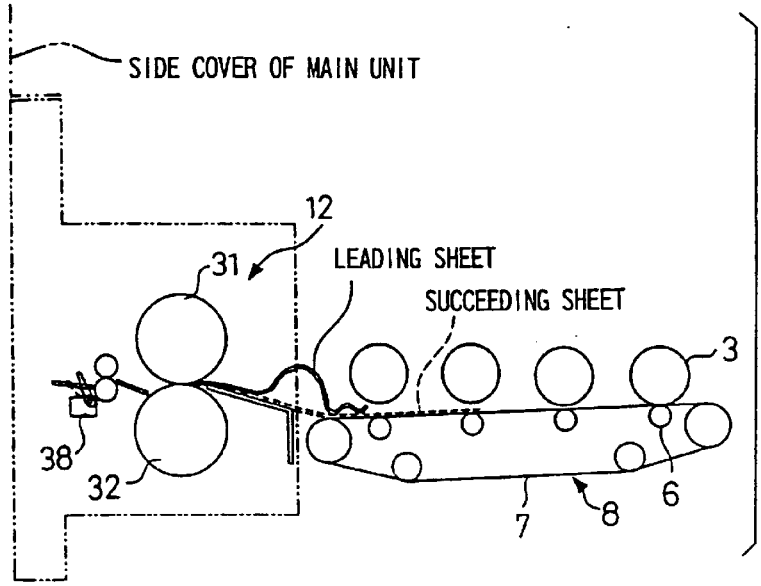
FIGS. 9A and 9B are diagrams for explaining the stopping condition of the leading sheet and the succeeding sheet and the jam handling performed by drawing out the fixing section.
Figure 9B:
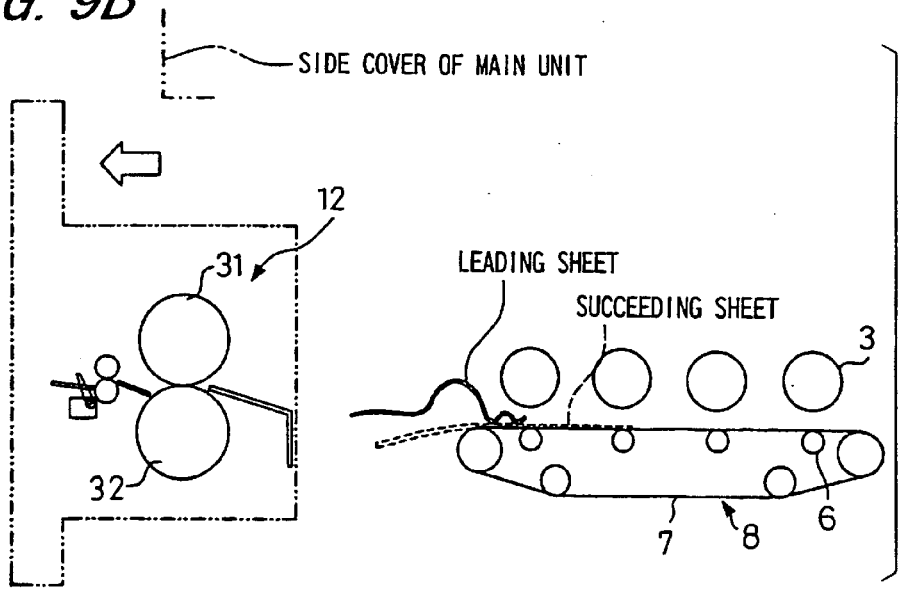

That is, immediately after the occurrence of a jam, the image forming operation and the rotating operation of the fixing section 12 are stopped, and after a prescribed time has elapsed, when the condition such as shown in FIG. 9A is reached, the sheet transport operation is completely stopped. Then, when the fixing section 12 is drawn out of the main unit of the image forming apparatus by the operator in step S29, as shown in FIG. 9B, the transfer/transport unit 8 is further moved by the moving mechanism working in interlocking fashion with the drawing out action, and the transfer belt 7 is thus separated from all the photoconductor drums 3.

Then, the operator performs the recovery work (jam handling) to remove the two sheets, as described above.

After the jam handling is completed, the operator pushes the fixing section 12 back into the main unit of the image forming apparatus, thereby restoring the transfer/transport unit 8 to the original condition (the condition in which only the photoconductor drum 3*a* is in contact with the transfer belt 7).

Next, in step S30, the jam handling control unit 100*a* checks again to see whether there is any sheet remaining between the resist rollers 14 by using the sheet detector DA; if any sheet is remaining, then in steps S35 and S36 the sheet is transported until its lead edge just enters or sufficiently enters the area of the fixing section 12 in the same manner as previously described. In step S37, the operator performs the recovery work again.

After completing the recovery work, the process returns to S30 where the jam handling control unit 100*a* checks again to see whether there is any remaining sheet. If there is no remaining sheet in step S30, the jam handling control unit 100*a* determines that the recovery work (jam handling) has been completed, and the process proceeds to step S31 where the switching unit 38 is activated to bring the transfer belt 7 into contact with all the photoconductor drums 3.

After that, in step S32, preliminary operations of the process section, i.e., preparatory rotation operations (preparatory operations such as the cleaning of the photoconductor drums 3 and the transfer belt 7) are started under the control of the jam handling control unit 100*a*, and when the preparatory rotation operations are completed in step S33, the ready lamp on the operation panel is turned on in step S34, and the image forming apparatus is thus set in the standby mode ready for image formation.

The flow from step S30 back to step S35 via steps S35 to S37 is the flow performed just to make sure, and is the same as the previously described flow from step steps S7 to S10 and back to step S7; therefore, the description of this flow will not be repeated here.

FIG. 14 shows a method for more reliably transporting, in the second jam handling operation, the succeeding sheet stopped in the upstream part at the time of an emergency stop. Here, steps S35' and S36' are the same as the previously described steps S8' and S9' and are performed for the same purpose; therefore, the description will not be repeated here.

Figure 10:
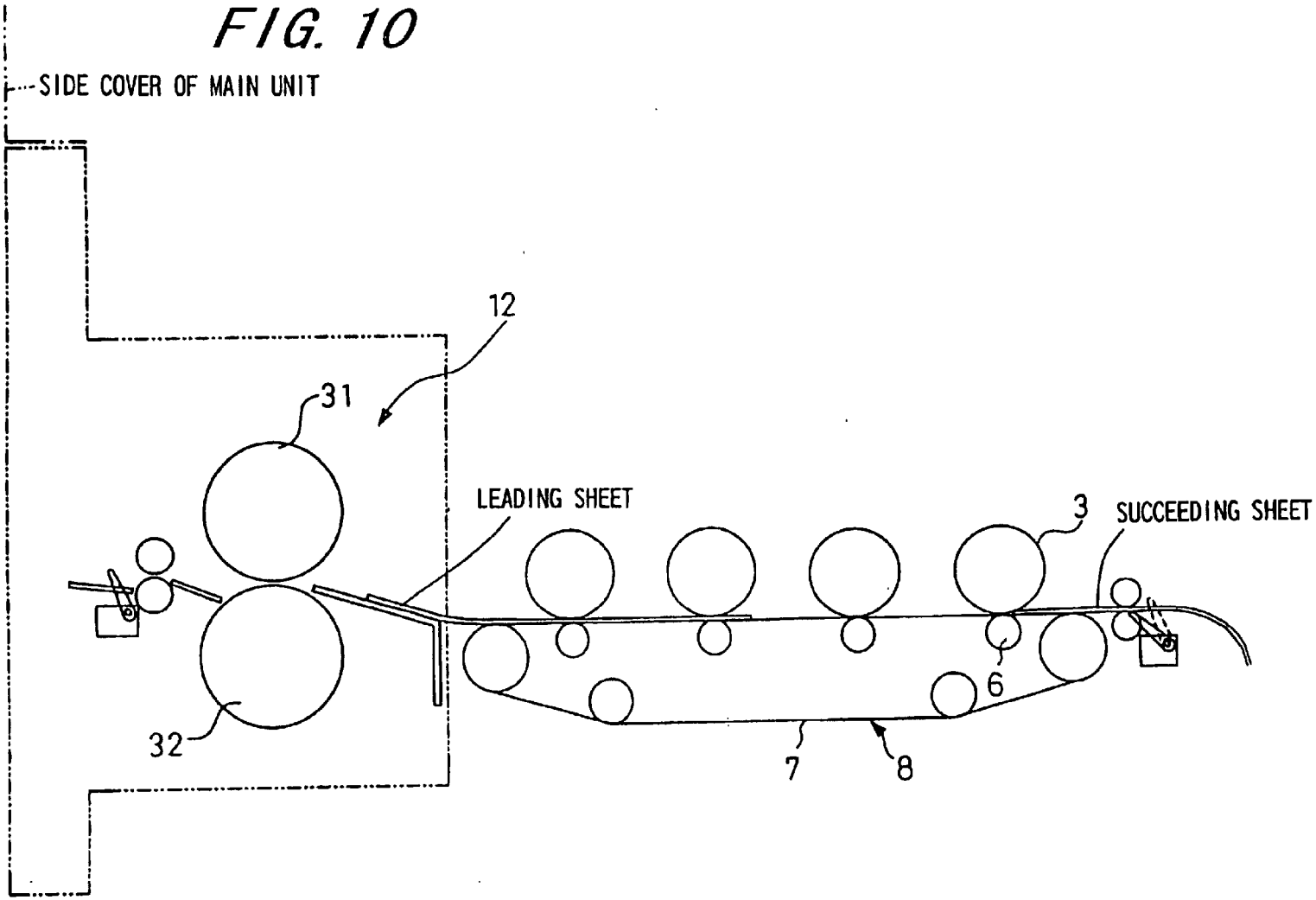
FIG. 10 is a diagram for explaining another example of the emergency stop condition.

The example shown in FIG. 15 concerns an embodiment that can accomplish jam handling in a more efficient and reliable way. The method shown here assumes the case where a plurality of sheets are carried on the transfer belt 7, as shown in FIG. 10, at the time of the occurrence of a jam; in this jam handling method, when the leading sheet has been fed between the rollers 31 and 32 in the fixing section 12, the transport operation is stopped so that the sheet will not be transported toward the downstream side of the fixing section 12, and in this condition, the succeeding sheets are transported until they stop at the position just before the rollers 31 and 32 in the fixing section 12.

That is, after an image forming operation is started in step S41, if a jam is detected in step S42, the image forming operation (write operation to the photoconductor drums 3 by the exposure unit 1, developing operation by the developer units 2, etc.) is stopped in step S43 under the control of the jam handling control unit 100*a*. As for the operation of the fixing section 12, the heating operation by the heater may be stopped, but the rotating operation of the rollers 31 and 32 is continued. At almost the same time, in step S44 the jam handling control unit 100*a* activates the switching unit 38 to turn the transfer/transport unit 8 in such a manner as to separate the transfer belt 7 from the photoconductor drums 3*b*, 3*c*, and 3*d*.

The reason for this is, as previously described, to reduce the force working to attract the sheet to the transfer belt 7 as much as possible, thereby facilitating the removal of the sheet from the transfer belt 7, and also to prevent the images already formed on the photoconductor drums 3*b*, 3*c*, and 3*d* from being transferred to the sheet. At the same time, in step S45 the application of the transfer bias to the transfer rollers 6 is also stopped.

At this time, an AC high voltage may be applied to the transfer rollers 6*b*, 6*c*, and 6*d* to actively reduce the attractive force. The reason for this is to reduce the force working to attract the sheet to the transfer belt 7 and also to prevent the image already formed on the photoconductor drum 3*a* from being transferred to the sheet.

Further, in step S46, the rotation of the photoconductor drums 3*b*, 3*c*, and 3*d* thus separated is stopped under the control of the jam handling control unit 100*a*. When a prescribed time has elapsed in step S47, that is, when the leading sheet is caught between the rollers 31 and 32 in the fixing section 12, the jam handling control unit 100*a* in step S48 causes the rotating operation of the rollers 31 and 32 in the fixing section 12 to stop, while keeping rotating the transfer belt 7 and at least the resist rollers 14 on the downstream side. After that, when the lead edge of the succeeding sheet has passed under the leading sheet and just entered or sufficiently entered the area of the fixing section 12, the jam handling control unit 100*a* causes the sheet transport operation of the transfer belt 7, etc. to stop.

Figure 11A:
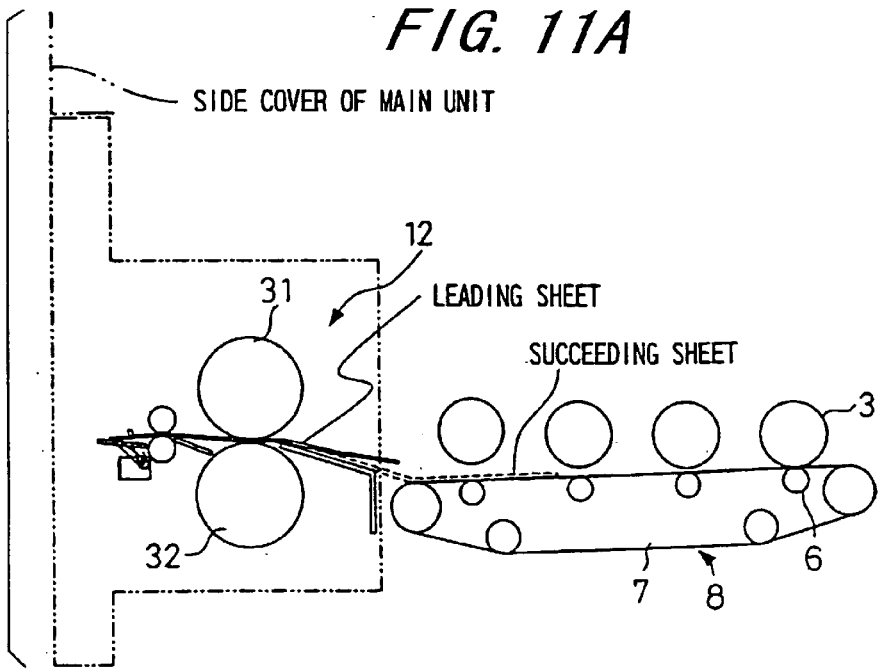
FIGS. 11A and 11B are diagrams for explaining the stopping condition of the leading sheet and the succeeding sheet and the jam handling performed by drawing out the fixing section.
Figure 11B:
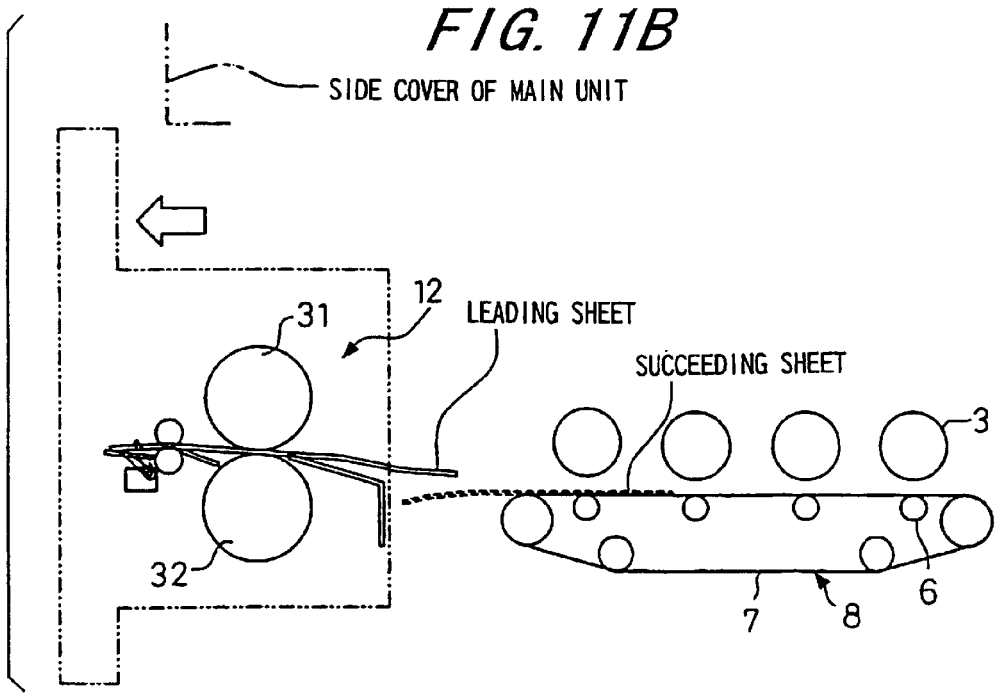

In step S50, the operator performs the recovery work in the same manner as previously described. The sheets remain stopped as shown in FIG. 11A, and the recovery work can be easily performed by drawing out the fixing section 12 as shown in FIG. 11B. At this time, the transport of each sheet is stopped under the control of a timer based on the detection made by the sheet detector DA, but the detection may be made using the sheet detector DB or DC located on the upstream side of the sheet.

That is, in this case, first in step S43, the jam handling control unit 100*a* causes only the image forming operation to stop (while keeping driving the fixing rollers); then, based on the detection timing of the sheet detector DA, or after the sheet is detected by the sheet detector DB or DC, that is, after waiting for a prescribed time in step S47, the jam handling control unit 100*a* causes the operation of the fixing section 12 to stop in step S48. Further, after waiting for the prescribed time, the jam handling control unit 100*a* causes the sheet transport operation to completely step in step S49. Thereafter, in step S50, the operator draws the fixing section 12 out of the main unit of the image forming apparatus. The moving mechanism, in interlocking fashion with this action, moves the transfer/transport unit 8 in such a manner as to separate it from all the photoconductor drums 3. After that, the operator performs the recovery work (jam handling).

In the above process, after stopping the image forming operation upon detecting the jam in step S42, the operation of the fixing section 12 is stopped in step S48 after waiting for the prescribed time; the reason for this is to secure the time required to feed the leading sheet between the rollers 31 and 32 in the fixing section 12 as shown in FIG. 11A. At this time, the succeeding sheet (shown by dotted line) is transported and stopped at the position just before the rollers 31 and 32. By further transporting the succeeding sheet, the sheet can be advanced to the position where it hits the roller 31 and 32.

In this way, by feeding the leading sheet between the rollers 31 and 32 and by transporting the succeeding sheet into the fixing unit 12, the leading sheet and the succeeding sheet can be removed at the same time when the fixing section 12 is drawn out, and thus the jam handling can be accomplished in a single operation.

Steps S51 to S58 are the same as the previously described steps S7 to S14 or steps S30 to S37, and therefore, the description thereof will not be repeated here. Further, steps S52 and S53 are the same as the previously described steps S8' and S9' or steps S35' and S36', and therefore, the description thereof will not be repeated here.

As described above, according to the invention, when handling a jam, any sheet remaining between the upstream-side photoconductor drum 3 and the transfer belt 7, and therefore likely to be left unnoticed, or any sheet electrostatically attracted to the transfer belt and hard to remove from it, is advanced along the transport direction to a position where it can be easily removed. This facilitates the jam handling.

Furthermore, by reducing the force working to attract the sheet to the transfer belt 7, the jam handling efficiency can be drastically improved without increasing the number of components and without increasing the manufacturing and assembling costs. This also contributes to reducing the size and weight of the image forming apparatus.

The invention is not limited to the particular embodiments described above, but various changes and modification in design may be made as necessary as long as the changes or modifications do not depart from the sprit and scope of the invention. Further, the image forming apparatus is not limited to the construction shown in FIGS. 1 and 2, but any suitable construction or type may be employed, the only requirement being that the image forming apparatus be of the type that transfers a toner image formed on an image carrier onto a sheet-like recording member being transported on a transfer carrier with the recording member made to adhere to it, and be equipped with jam handling control means for detecting a transport fault occurring during the transport of the sheet-like recording member, and for stopping the transport operation of the sheet-like recording member when the transport fault is detected.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

an image carrier for carrying a toner image formed thereon;

a transfer carrier for transferring the toner image formed on the image carrier to a sheet-like recording member which is transported and attracted to the transfer carrier;

jam handling control means for detecting a transport fault of the sheet-like recording member, and for stopping a transport operation for the sheet-like recording member when the transport fault is detected; and a fixing unit capable of being drawn out in the transport direction of the sheet-like recording member, the fixing unit being disposed on the downstream side of the transport of the transfer carrier as viewed along the transport direction of the sheet-like recording member, wherein when the sheet transport fault is detected, the jam handling control means first causes the sheet-like recording member transport operation of the fixing unit to stop and thereafter causes the transport operation of the transfer carrier and sheet transport means on the upstream side thereof to stop so that any sheet-like recording member remaining on the transfer carrier or on the sheet transport means on the upstream side thereof is transported and stopped at a prescribed position spanning between an area where the fixing unit is located and an area where the transfer carrier is located.

2. The image forming apparatus of claim 1, wherein the prescribed position spanning between the area of the fixing unit and the area of the transfer carrier is a position just before the lead edge of the sheet-like recording member is caught between roller members of the fixing unit.

3. The image forming apparatus of claim 1, wherein the prescribed position spanning between the area of the fixing unit and the area of the transfer carrier is a position where the lead edge of a leading sheet-like recording member is caught between roller members of the fixing unit and where a succeeding sheet-like recording member is at a position just before the lead edge thereof is caught between the roller members of the fixing unit.

4. The image forming apparatus of claim 1, further comprising:

a transfer carrier unit for supporting the transfer carrier thereon; and a moving mechanism for causing the transfer carrier to be brought into contact with or be separated from the image carrier by moving the transfer carrier unit closer to or away from the image carrier, wherein when a sheet-like recording member transport fault is detected, the moving mechanism starts to move the transfer carrier unit away from the image carrier before the transport of the sheet-like recording member by the transfer carrier is stopped.

5. The image forming apparatus of claim 4, wherein a plurality of the image carriers are arranged along a direction in which the transfer carrier is rotated, and when a sheet-like recording member transport fault is detected, the moving mechanism starts to move the transfer carrier unit away from the plurality of image carriers before the transport of the sheet-like recording member by the transfer carrier is stopped, and at the same time, of the plurality of image carriers, the image carriers separated from the transfer carrier are caused to stop rotating, after which, of the plurality of image carriers, the image carrier still in contact with the transfer carrier is caused to stop rotating when the transport of the sheet-like recording member by the transfer carrier is stopped.

6. The image forming apparatus of claim 1, wherein the image forming apparatus comprises a plurality of the image carriers and switching means for selectively switching between a multicolor mode, in which an image is formed using all the image carriers, and a single-color mode, in which an image is formed using a selected one of the image carriers, the image carriers and the transfer carrier being set in a different contacting relationship in one mode than in the other, wherein when a sheet-like recording member transport fault is detected during the formation of an image in the multicolor mode, the switching means thereafter switches the contacting relationship between the transfer carrier and the image carriers to the contacting relationship used in the single-color mode.

7. The image forming apparatus of claim 1, further comprising a transfer member for applying a transfer bias to the transfer carrier, wherein when a sheet-like recording member transport fault is detected, the transfer member cuts off the transfer bias being supplied to the transfer carrier.

* * * * *